US009797280B2

(12) United States Patent
Beyer et al.

(10) Patent No.: US 9,797,280 B2
(45) Date of Patent: Oct. 24, 2017

(54) CAMSHAFT THRUST BEARING LUBRICATION SYSTEM

(71) Applicant: Ford Global Technologies, LLC, Dearborn, MI (US)

(72) Inventors: Theodore Beyer, Canton, MI (US); Jon Michael LaCroix, Novi, MI (US); Chuck Joseph Patanis, South Lyon, MI (US); Jonathan Denis Crowe, Northville, MI (US); Paul John Adam, Windsor, CA (US)

(73) Assignee: Ford Global Technologies, LLC, Dearborn, MI (US)

( * ) Notice: Subject to any disclaimer, the term of this patent is extended or adjusted under 35 U.S.C. 154(b) by 96 days.

(21) Appl. No.: 14/879,644

(22) Filed: Oct. 9, 2015

(65) Prior Publication Data

US 2017/0101909 A1 Apr. 13, 2017

(51) Int. Cl.

| | |
|---|---|
| ***F01M 9/10*** | (2006.01) |
| ***F01L 1/047*** | (2006.01) |
| ***F01L 1/34*** | (2006.01) |
| ***F01L 9/02*** | (2006.01) |
| ***F01M 1/02*** | (2006.01) |
| ***F01M 1/16*** | (2006.01) |
| ***F01M 11/00*** | (2006.01) |

(52) U.S. Cl.

CPC ..... *F01M 9/102* (2013.01); *F01L 1/047* (2013.01); *F01L 1/34* (2013.01); *F01L 9/02* (2013.01); *F01M 1/02* (2013.01); *F01M 1/16* (2013.01); *F01M 11/0004* (2013.01); *F01L 2001/0476* (2013.01)

(58) Field of Classification Search

CPC F01M 9/102; F01M 1/02; F01M 1/16; F01M 11/0004; F01L 1/047; F01L 2001/0476; F01L 1/34; F01L 9/02

USPC ..... 123/90.16, 90.27

See application file for complete search history.

(56) References Cited

U.S. PATENT DOCUMENTS

| | | | | |
|---|---|---|---|---|
| 4,199,202 A * | 4/1980 | Maeda | ..... | F01L 1/04 123/196 R |
| 5,954,019 A | 9/1999 | Yoshikawa et al. | | |
| 6,186,105 B1 | 2/2001 | Yonezawa | | |
| 6,289,861 B1 | 9/2001 | Suzuki | | |

(Continued)

FOREIGN PATENT DOCUMENTS

EP 1046793 A2 10/2000

*Primary Examiner* — Phutthiwat Wongwian
*Assistant Examiner* — Loren Edwards
(74) *Attorney, Agent, or Firm* — Greg Brown; McCoy Russell LLP

(57) ABSTRACT

Methods and systems are provided for regulating oil flow to advance and retard chambers of a variable cam timing (VCT) system and to a thrust bearing of a camshaft via an oil control valve. In one example, an oil control valve may be housed within a cam journal cap the cam journal cap comprising a thrust bearing for receiving and retaining a camshaft. The cam journal cap may include a vertical bore configured to house the control valve, where the vertical bore may include a first port for receiving oil from an oil pump, a second port for flowing oil to an advance chamber of a VCT system, a third port for flowing oil to a retard chamber of the VCT system, a fourth port, coupled to the thrust bearing for flowing oil thereto, and a drain port for flowing oil to an oil sump.

22 Claims, 10 Drawing Sheets

(56) References Cited

U.S. PATENT DOCUMENTS

| | | | | |
|---|---|---|---|---|
| 7,942,121 | B2 * | 5/2011 | Lunsford | F01L 1/344<br>123/90.17 |
| 8,667,944 | B2 * | 3/2014 | Beyer | F02F 1/24<br>123/193.5 |
| 2007/0251474 | A1 * | 11/2007 | Gauthier | F01L 1/3442<br>123/90.17 |

* cited by examiner

CAMSHAFT THRUST BEARING LUBRICATION SYSTEM

FIELD

The present description relates generally to methods and systems for controlling a vehicle engine to lubricate a camshaft thrust bearing.

BACKGROUND/SUMMARY

In overhead camshaft systems including a variable valve timing mechanism, a cam cover or cam journal cap may be included at an axial end of the camshafts to retain the camshafts and regulate oil flow to the variable valve timing mechanism. For example, U.S. Pat. No. 6,186,105 to Yonezawa discloses a cam journal cap that houses a control valve which controls oil flow to a variable valve timing mechanism. Specifically, the control valve receives oil from the engine oil system, and directs the oil to advance and/or retard chambers of a camshaft phaser to adjust the timing (e.g., phase angle) of the camshaft relative to a driving element of the camshaft such as a crankshaft.

To restrict translational movement of the camshafts relative to the engine cylinder head and cam journal cap, the camshafts may include a flange, which may be commonly referred to as a thrust ring, that is received in a groove or bearing surface of the cam journal cap. However, as the camshafts rotate relative to the cylinder head and journal cap, the thrust ring and thrust bearing may require sufficient lubrication. Thus, oil may be routed to the thrust bearing for lubrication thereof. However, an oil circuit dedicated specifically to the thrust bearing may be costly and may increase packaging size of the engine system. Specifically, more oil and a larger oil pump may be required in systems where the thrust bearing has its own dedicated oil circuit.

Some attempts to address the material and energy costs associated with lubricating a thrust bearing include utilizing a portion of the oil supplied to the variable valve timing mechanism to lubricate the thrust bearing. One example approach is shown by Lunsford et al. in U.S. Pat. No. 7,942,121, where oil provided to the variable valve timing mechanism may be returned to the control valve, and then directed to a groove in the cylinder head which receives the thrust ring. Therein, oil used by the variable valve timing mechanism may be drained from the control valve to the thrust bearing for lubrication thereof.

However, the inventors herein have recognized potential issues with such systems. Specifically, oil flow to the control valve may be highly variable depending on engine operating conditions such as engine speed and load, oil temperature, and the oil budget of the engine system. Thus, as the amount of oil provided to the control valve varies, so too does the amount of oil directed to the thrust bearing. As such, in systems where oil provided to the thrust bearing is sourced from the control valve, lubrication of the thrust bearing may be inconsistent. Further, in systems where the thrust bearing is retained by the overhead cam journal cap, and thus lack a pocket in the cylinder head to retain oil, lubrication of the thrust bearing may be interrupted during low levels of oil flow to the control valve.

As one example, the issues described above may be addressed by a cam journal cap comprising a thrust bearing coupled to a camshaft, a vertical bore housing a control valve, the control valve regulating oil received from an oil pump to control a position of the camshaft, a port positioned in the vertical bore and coupled to the thrust bearing to supply oil thereto, and a drain port positioned in the vertical bore above the port and coupled to an oil sump.

The vertical bore in some examples may form a housing for the control valve, and the control valve may include a spool, movable within the control valve's body for adjusting oil flow through the valve. However, each of the port and the drain port may be positioned within the vertical bore vertically below a bottom end of the spool and body of the control valve. Further, the port and drain port may be hydraulically in parallel, so that oil may flow out of both the port and drain port when oil levels in the valve exceed a threshold. Otherwise, oil may flow out of the port and not the drain port.

In another example, a cam journal cap may comprise a thrust bearing for receiving a thrust ring of a camshaft, and a vertical bore configured to house a control valve for a variable camshaft timing (VCT) system, said vertical bore including a first port for receiving oil from an oil pump, a second port for flowing oil to an advance chamber of the VCT system, a third port for flowing oil to a retard chamber of the VCT system, a fourth port, coupled to the bearing for flowing oil thereto, and a drain port for flowing oil to an oil sump.

In this way, consistency of oil flow to a thrust bearing may be increased, and the size and cost of an engine oil system may be reduced. By providing oil to the thrust bearing from an oil control valve of a variable cam timing system, an amount of oil in the engine oil system, and therefore the size of a pump of the oil system may be reduced. Further, by providing a vertical bore in the cam journal cap which houses the control valve, inherent oil leakage of the control valve may be collected at the bottom of the vertical bore. Oil collected at the bottom of the vertical bore may then be used to lubricate the thrust bearing. Further, oil levels in the vertical bore may be kept to within a desired range by draining excess oil through a drain port in the vertical bore when oil levels in the vertical bore exceed a threshold. In this way, oil levels in the bottom of the vertical bore may be kept at high enough levels to provide consistent oil flow to the thrust bearing for lubrication thereof. However, oil levels may be kept below levels which would inhibit operation of the control valve.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 4-8 are shown approximately to scale.

DETAILED DESCRIPTION

Figure 1:
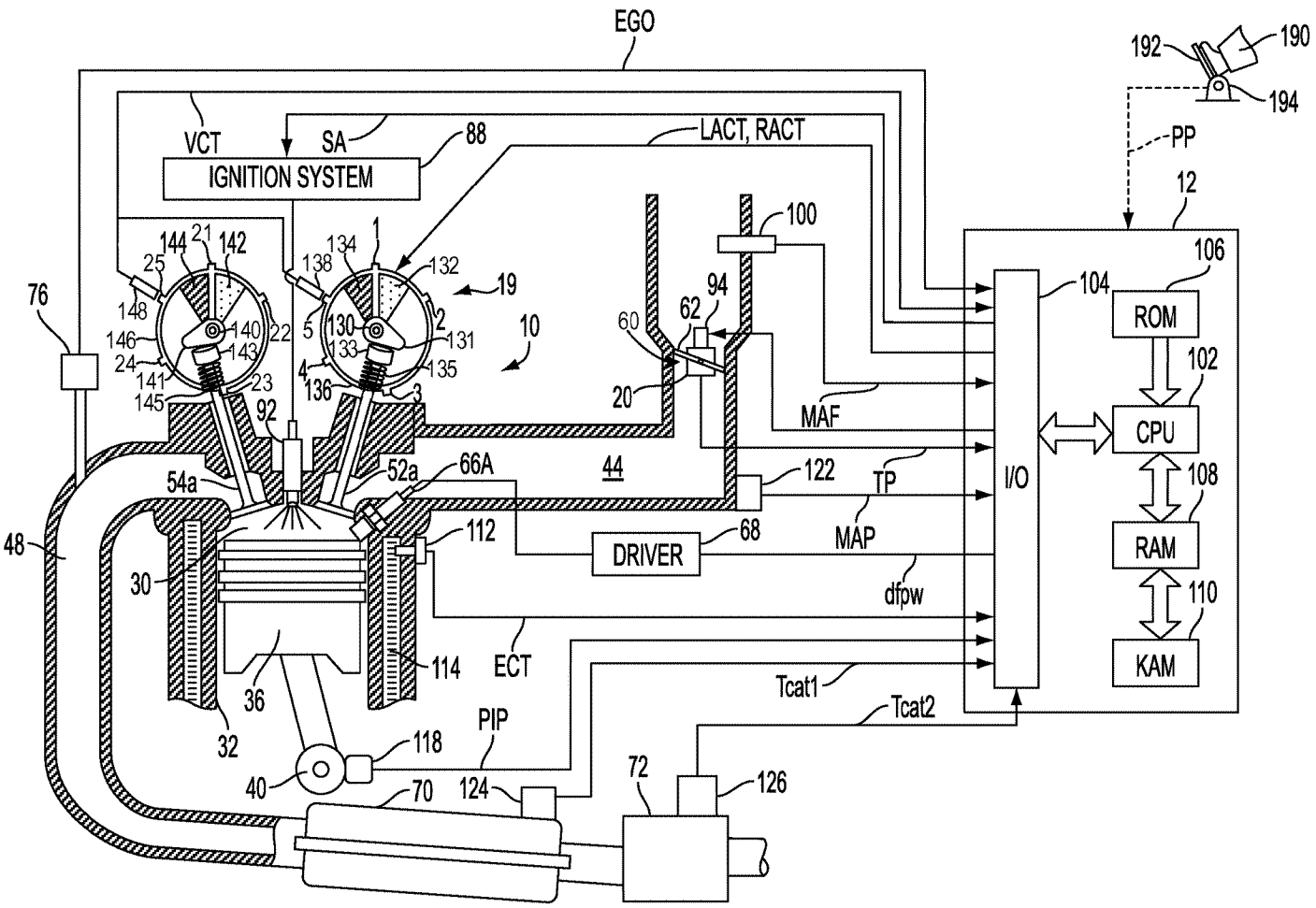
FIG. 1 shows a schematic diagram of an example engine system including a variable cam timing system.

The following description relates to systems and methods for regulating oil flow within a cam journal cap. In an overhead variable camshaft timing system as shown in FIG. 1, one or more camshafts may be provided vertically above the cylinder head for actuating intake and/or exhaust valves of the engine cylinders. To improve engine performance under certain engine operating conditions, the timing of the camshaft relative to a crankshaft may be adjusted by flowing oil into an advance and/or retard chambers of a variable cam timing system. Oil may be provided to the variable cam timing system from an engine oil system, such as the engine oil system shown in FIG. 2. The amount of oil flowing to the advance and retard chambers may be regulated by an oil control valve, an example of which is shown in FIGS. 3A-3C.

Figure 7:
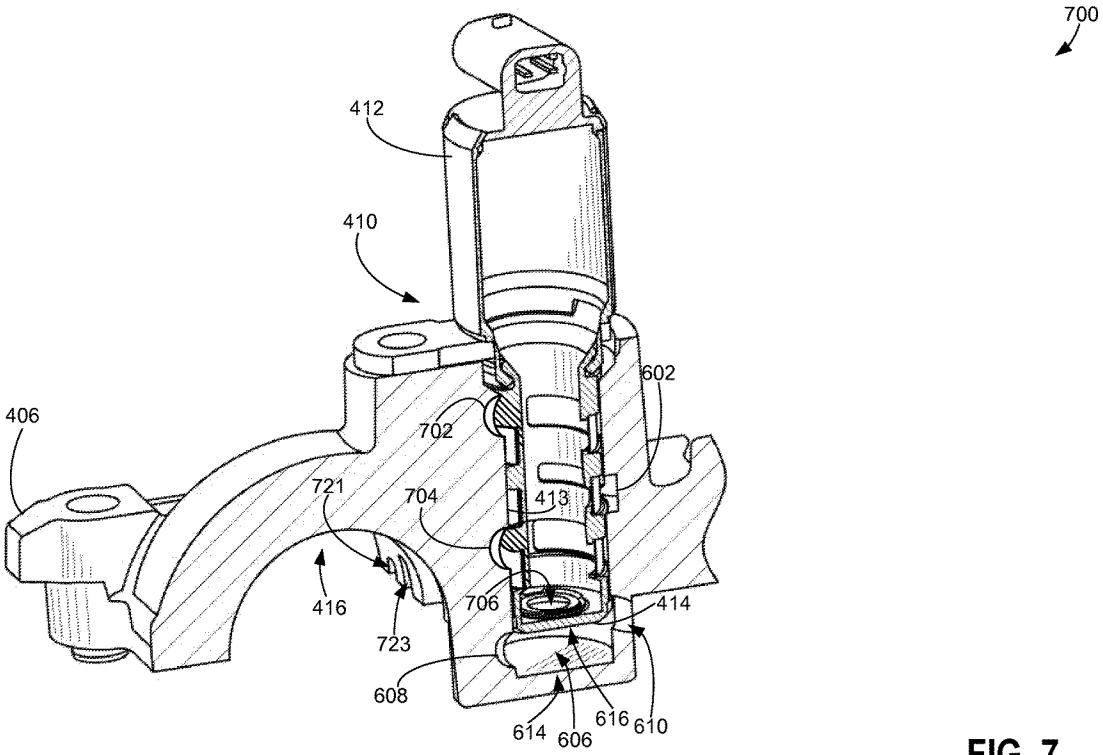
FIG. 7 illustrates an internal side view of the cam journal cap of FIG. 4.
Figure 8:
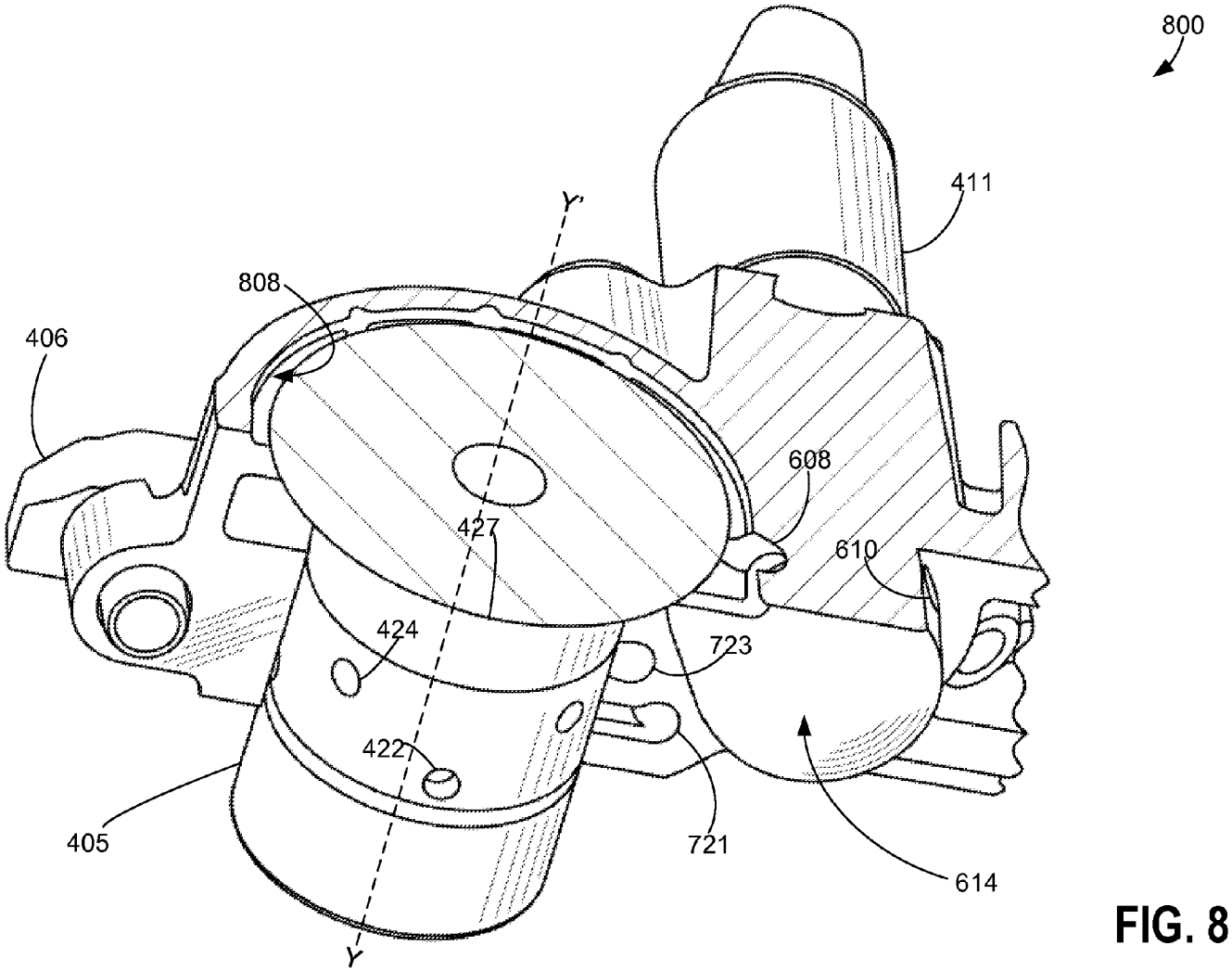
FIG. 8 illustrates a bottom view of the cam journal cap of FIG. 4.
Figure 9:
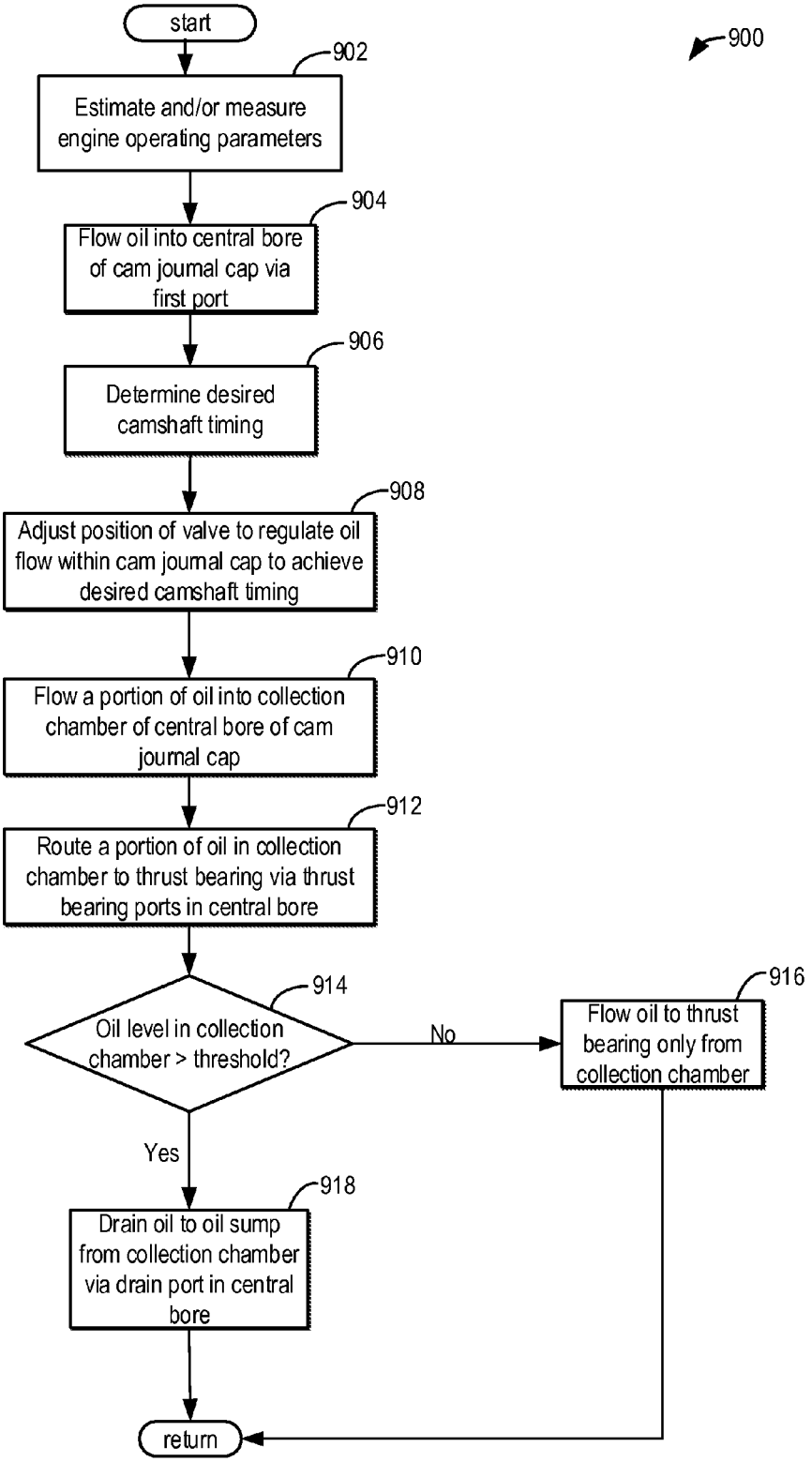
FIG. 9 shows a flow chart of a method for adjusting oil flow through a control valve of a variable cam timing system.

The oil control valve may be housed within a cam journal cap, which may also comprise a thrust bearing for receiving and retaining the camshaft. An example cam journal cap is shown in FIGS. 4-8. Specifically, the cam journal cap may comprise a vertical bore which may serve as the housing for the oil control valve, and which contains a plurality of ports for directing oil flow into and out of the valve. Oil in the control valve may drain to the bottom of the vertical bore where it may collect during engine operation. One of the ports may be positioned at the bottom of the vertical bore and may be in fluidic communication with the thrust bearing for providing lubricating oil thereto. A drain port may be positioned vertically above the port in fluidic communication with the thrust bearing, for draining excess oil from the valve, when oil levels in the valve exceed a threshold. In this way, the cam journal cap and oil control valve may regulate oil flow to both the variable cam timing system for adjusting the timing of the camshaft, as well as providing a consistent flow of oil to the thrust bearing for lubrication thereof. FIG. 9 shows an example method for regulating oil flow through the control valve to the thrust bearing and chambers of the variable cam timing system.

FIG. 1 depicts an example embodiment of a combustion chamber or cylinder of internal combustion engine 10. FIG. 1 shows that engine 10 may receive control parameters from a control system including controller 12, as well as input from a vehicle operator 190 via an input device 192. In this example, input device 192 includes an accelerator pedal and a pedal position sensor 194 for generating a proportional pedal position signal PP.

Cylinder (herein also "combustion chamber") 30 of engine 10 may include combustion chamber walls 32 with piston 36 positioned therein. Piston 36 may be coupled to crankshaft 40 so that reciprocating motion of the piston is translated into rotational motion of the crankshaft. Crankshaft 40 may be coupled to at least one drive wheel of the passenger vehicle via a transmission system. Further, a starter motor may be coupled to crankshaft 40 via a flywheel to enable a starting operation of engine 10. Crankshaft 40 may be coupled to oil pump (not shown in FIG. 1) to pressurize an engine oil lubrication system. Housing 136 is hydraulically coupled to crankshaft 40 via a timing chain or belt (not shown).

Cylinder 30 can receive intake air via intake manifold or air passages 44. Intake air passage 44 can communicate with other cylinders of engine 10 in addition to cylinder 30. In some embodiments, one or more of the intake passages may include a boosting device such as a turbocharger or a supercharger. A throttle 60 comprising one or more of a throttle plate 62, electric motor 94, and throttle position sensor 20 may be provided along an intake passage of the engine for varying the flow rate and/or pressure of intake air provided to the engine cylinders. In this particular example, throttle plate 62 is coupled to electric motor 94 so that the position of elliptical throttle plate 62 may be controlled by controller 12 via electric motor 94. Specifically, the controller 12 may send signals to the electric motor 94 for adjusting the position of the throttle plate 62 based on input from the vehicle operator 190 via the input device 192. This configuration may be referred to as electronic throttle control (ETC), which can also be utilized during idle speed control.

Combustion chamber 30 is shown communicating with intake manifold 44 and exhaust manifold 48 via respective intake valves 52*a* and 52*b* (not shown), and exhaust valves 54*a* and 54*b* (not shown). Thus, while four valves per cylinder may be used, in another example, a single intake and single exhaust valve per cylinder may also be used. In still another example, two intake valves and one exhaust valve per cylinder may be used. In still another example, one intake valve and two exhaust valves per cylinder may be used.

Exhaust manifold 48 can receive exhaust gases from other cylinders of engine 10 in addition to cylinder 30. Exhaust gas sensor 76 is shown coupled to exhaust manifold 48 upstream of catalytic converter 70 (where sensor 76 can correspond to various different sensors). For example, sensor 76 may be any of many known sensors for providing an indication of exhaust gas air/fuel ratio such as a linear oxygen sensor, a UEGO, a two-state oxygen sensor, an EGO, a HEGO, or an HC or CO sensor. Emission control device 72 is shown positioned downstream of catalytic converter 70. Emission control device 72 may be a three-way catalyst, a NOx trap, various other emission control devices or combinations thereof.

In some embodiments, each cylinder of engine 10 may include a spark plug 92 for initiating combustion. Ignition system 88 can provide an ignition spark to combustion chamber 30 via spark plug 92 in response to spark advance signal SA from controller 12, under select operating modes. However, in some embodiments, spark plug 92 may be omitted, such as where engine 10 may initiate combustion by auto-ignition or by injection of fuel, as may be the case with some diesel engines.

In some embodiments, each cylinder of engine 10 may be configured with one or more fuel injectors for providing fuel thereto. As a non-limiting example, fuel injector 66A is shown coupled directly to cylinder 30 for injecting fuel directly therein in proportion to the pulse width of signal dfpw received from controller 12 via electronic driver 68. In this manner, fuel injector 66A provides what is known as direct injection (hereafter also referred to as "DI") of fuel into cylinder 30. The fuel injector may be mounted in the side of the combustion chamber (as shown) or in the top of the combustion chamber (near the spark plug), for example. Fuel may be delivered to fuel injector 66A by a fuel system including a fuel tank, a fuel pump, and a fuel rail. In some embodiments, combustion chamber 30 may alternatively or additionally include a fuel injector arranged in intake manifold 44 in a configuration that provides what is known as port injection of fuel into the intake port upstream of combustion chamber 30.

Controller 12 is shown as a microcomputer, including microprocessor unit 102, input/output ports 104, an electronic storage medium for executable programs and calibration values shown as read only memory chip 106 in this particular example, random access memory 108, keep alive memory 110, and a conventional data bus. Controller 12 is shown receiving various signals from sensors coupled to engine 10, in addition to those signals previously discussed, including measurement of inducted mass air flow (MAF) from mass air flow sensor 100 coupled to throttle 60; engine coolant temperature (ECT) from temperature sensor 112 coupled to cooling sleeve 114; a profile ignition pickup signal (PIP) from Hall effect sensor 118 coupled to crankshaft 40; and throttle position (TP) from throttle position sensor 20; and absolute Manifold Pressure Signal (MAP) from sensor 122. Engine speed signal (RPM) may be generated by controller 12 from signal (PIP) in a conventional manner and manifold pressure signal (MAP) from a manifold pressure sensor provides an indication of vacuum, or pressure, in the intake manifold. During stoichiometric operation, this sensor can give an indication of engine load. Further, this sensor, along with engine speed, can provide an estimate of charge (including air) inducted into the cylinder. In one example, sensor 118, which is also used as an engine speed sensor, produces a predetermined number of equally spaced pulses every revolution of the crankshaft.

In this particular example, temperature $T_{cat1}$ of catalytic converter 70 is provided by temperature sensor 124 and temperature $T_{cat2}$ of emission control device 72 is provided by temperature sensor 126. In an alternate embodiment, temperature Tcat1 and temperature Tcat2 may be inferred from engine operation and temperature sensor 124 and 126 may be omitted.

Continuing with FIG. 1, a variable camshaft timing (VCT) system 19 is shown. In this example, an overhead cam system is illustrated, although other approaches may be used. Specifically, VCT system 19 may be a dual independent overhead camshaft timing system comprising an intake camshaft 130 and an exhaust camshaft 140. Intake camshaft 130 may communicate with intake valves 52*a* and 52*b* for adjusting the position of the valves 52*a* and 52*b*. Similarly exhaust camshaft 140 may communicate with exhaust valve 54*a* and 54*b* for adjusting the position of the valves 54*a* and 54*b*. Thus, the exhaust valves and the intake valves of engine 10 may be actuated by their own independent camshafts: one camshaft for the intake valves, and another camshaft for the exhaust valves. It should be appreciated that in other examples, the engine 10 may include more than one cylinder bank. In such examples, each cylinder bank may include an intake camshaft for actuating the intake valves, and an exhaust camshaft for actuating the exhaust valves. Thus, the engine 10 may include more than one intake camshaft and one exhaust camshaft depending on the number of cylinder banks. Further, in some embodiments, VCT system 19 may include only a single camshaft, which may communicate with rocker arms (not shown in FIG. 1) for actuating intake valves 52*a*, 52*b* and exhaust valves 54*a*, 54*b*. Thus, in some examples a single camshaft may be used to actuate both the intake and exhaust valves.

In the example of FIG. 1, the intake valves, 52*a* and 52*b*, and the exhaust valves, 54*a* and 54*b*, may be actuated by respective camshafts 130 and 140. Said another way, the position of the intake valves 52*a* and 52*b* may be adjusted by rotation of the intake camshaft 130, and the position of the exhaust valves 54*a* and 54*b* may be adjusted by rotation of the exhaust camshaft 140. Each of the intake valves 52*a* and 52*b* may be actuable between an open position that allows intake air into the corresponding cylinder 30 and a closed position substantially blocking intake air from the cylinder 30. Intake camshaft 130 may include intake cam lobes 131 which have a lift profile for opening the intake valves 52*a* and 52*b* for a defined intake duration. As shown in the example of FIG. 1, the position of the intake valve 52*a* may be adjusted by exactly one of the cam lobes 131. Thus, in some examples, each of the intake valves 52*a* and 52*b* may be actuated by one of the cam lobes 131. As such, examples where each cylinder comprises two intake valves, the intake valves of each cylinder 30 of engine 10 may be actuated by two cam lobes 131. In examples where only one intake valve is included in each cylinder 30, the intake valves of each cylinder 30 may be actuated by one cam lobe.

However, in other embodiments (not shown), the intake camshaft 130 may include additional intake cam lobes with an alternate lift profiles, that may allow the intake valves 52*a* and 52*b* to be opened for an alternate lift and/or duration (herein also referred to as a cam profile switching system). Based on the lift profile of the additional cam lobe, the alternate duration may be longer or shorter than the defined intake duration of intake cam lobes 131. The lift profile may affect cam lift height, cam duration, opening timing, and/or closing timing. Controller 12 may be able to switch the intake valve duration by moving the intake cam lobes 131 longitudinally and switching between cam profiles. In another embodiment, controller 12 may be able to switch the intake valve duration by latching or unlatching rocker arms, cam followers, or other mechanisms between cam lobes 131 and intake valves 52*a* and 52*b*.

Thus, rotational motion of the intake camshaft 130 and cam lobes 131 may be converted into translational motion of the intake valves 52*a* and 52*b*. Each of the cam lobes 131 may be in communication with an intake tappet 133 and intake valve spring 135 for adjusting the position of the intake valves. Specifically, each of the cam lobes 131 may be in face-sharing contact with an intake tappet 133, and as the camshaft 130 and cam lobes 131 rotate, the tappet 133, spring 135, and intake valve 52*a* may be displaced according to the lift profile of the cam lobe. Although camshaft 130 and cam lobes 131 are shown to be in communication with tappets and springs of corresponding intake valves, it should be appreciated that in other embodiments, the intake valves 52*a* and 52*b* may be actuated by additional components such as push rods, rocker arms, etc. In still further embodiments, camshaft 130 and cam lobes 131 may not be in communication with one or more of the tappets and springs, and may instead be in communication with push rods, rocker arms, etc. for actuating the intake valves 52*a* and 52*b*. Further still, various combinations of springs, push rods, tappets, rocker arms, etc. may be used for converting the rotational motion of the camshaft 130 and cam lobes 131 into translational motion of the intake valves 52*a* and 52*b*.

The intake valves may also be actuated via additional cam lobe profiles on the camshafts, where the cam lobe profiles between the different valves may provide varying cam lift height, cam duration, and/or cam timing. However, alternative camshaft (overhead and/or pushrod) arrangements could be used, if desired.

In the depicted example of FIG. 1, VCT system 19 is oil-pressure actuated (OPA). By adjusting a plurality of hydraulic valves to thereby direct a hydraulic fluid, such as engine oil, into one or more cavities (such as an advance chamber or a retard chamber) of a camshaft phaser, valve timing may be changed, that is advanced or retarded. As further elaborated herein, the operation of the hydraulic control valves may be controlled by respective control solenoids. Specifically, controller 12 may transmit a signal to the solenoids to move a spool valve that regulates the flow of oil through the phaser cavity. As used herein, advance and retard of cam timing refer to relative cam timings, in that a fully advanced position may still provide a retarded intake valve opening with regard to top dead center, as just an example. However, in other examples, VCT system 19 may be cam-torque actuated (CTA), wherein actuation of a camshaft phaser of the VCT system is enabled via cam torque pulses.

Camshaft 130 may be hydraulically coupled to housing 136. Housing 136 may form a toothed wheel having a plurality of teeth 1, 2, 3, 4, and 5. While in the depicted example, housing 136 may comprise 5 teeth, it should be appreciated that in other examples, housing 136 may include more or less than 5 teeth. In one example, as in a four stroke engine, for example, housing 136 and crankshaft 40 may be mechanically coupled to camshaft 130 such that housing 136 and crankshaft 40 may synchronously rotate at a speed different than camshaft 130 (e.g., a 2:1 ratio, where the crankshaft rotates at twice the speed of the camshaft). In such examples, teeth 1, 2, 3, 4, and 5 may be mechanically coupled to camshaft 130. By manipulation of the hydraulic coupling as described herein, the relative position of camshaft 130 to crankshaft 40 can be varied by hydraulic pressures in retard chamber 132 and advance chamber 134. By allowing high pressure hydraulic fluid to enter retard chamber 132, the relative relationship between camshaft 130 and crankshaft 40 may be retarded. Thus, intake valves 52*a*, 52*b* may open and close at a time later than normal relative to crankshaft 40. Similarly, by allowing high pressure hydraulic fluid to enter advance chamber 134, the relative relationship between camshaft 130 and crankshaft 40 may be advanced. Thus, intake valves 52*a*, 52*b*, may open and close at a time earlier than normal relative to crankshaft 40. However, in other examples, housing 136 may be mechanically coupled to crankshaft 40 via a timing chain or belt for rotating housing 136 and camshaft 130 at a speed substantially equivalent to each other and synchronous to the crankshaft 40.

Continuing with actuation of the intake valves 52*a* and 52*b*, teeth 1 2, 3, 4, and 5, rotating synchronously with camshaft 130, may allow for measurement of relative cam position via cam timing sensor 138 providing signal VCT to controller 12. Specifically, teeth 1, 2, 3, and 4 may be used for measurement of cam timing and may be equally spaced (for example, in a V-8 dual bank engine, spaced 90 degrees apart from one another) while tooth 5 may be used for cylinder identification. Thus, outputs from the cam timing sensor 138 may be received by the controller 12 and used to estimate the position and/or timing of the camshaft 130. In addition, controller 12 sends control signals (LACT, RACT) to conventional solenoid valves (not shown) to control the flow of hydraulic fluid either into retard chamber 132, advance chamber 134, or neither.

Relative cam timing can be measured in a variety of ways. In general terms, the time, or rotation angle, between the rising edge of the PIP signal and receiving a signal from one of the plurality of teeth 1, 2, 3, 4, and 5, on housing 136 gives a measure of the relative cam timing. For the particular example of a V-8 engine, with two cylinder banks and a five-toothed wheel, a measure of cam timing for a particular bank is received four times per revolution, with the extra signal used for cylinder identification.

The exhaust valves, 54*a* and 54*b*, may be actuated in a similar manner to that described for the intake valves 52*a* and 52*b*. Thus, the position of the exhaust valves 54*a* and 54*b* may be adjusted by rotation of the exhaust camshaft 140. Each of the exhaust valves 54*a* and 54*b* may be actuable between an open position that allows air and/or fuel in the corresponding cylinder 30 to escape to the exhaust manifold 48, and a closed position substantially blocking air and/or fuel in cylinder 30 from the exhaust manifold 48. Exhaust camshaft 140 may include exhaust cam lobes 141 which have a lift profile for opening the exhaust valves 54*a* and 54*b* for a defined intake duration. As shown in the example of FIG. 1, the position of the exhaust valve 54*a* may be adjusted by exactly one of the cam lobes 141. Thus, in some examples, each of the exhaust valves 54*a* and 54*b* may be actuated by one of the exhaust cam lobes 141. As such, the exhaust valves of each cylinder 30 of engine 10 may be actuated by two cam lobes 141. In examples where only one exhaust valve is included in each cylinder 30, the exhaust valves of each cylinder 30 may be actuated by one cam lobe.

However, in other embodiments (not shown), the exhaust camshaft 140 may include additional exhaust cam lobes with an alternate lift profiles, that may allow the exhaust valves 54*a* and 54*b* to be opened for an alternate lift and/or duration (herein also referred to as a cam profile switching system). Based on the lift profile of the additional cam lobe, the alternate duration may be longer or shorter than the defined intake duration of exhaust cam lobes 141. The lift profile may affect cam lift height, cam duration, opening timing, and/or closing timing. Controller 12 may be able to switch the exhaust valve duration by moving the exhaust cam lobes 141 longitudinally and switching between cam profiles. In another embodiment, controller 12 may be able to switch the exhaust valve duration by latching or unlatching rocker arms, cam followers, or other mechanisms between cam lobes 141 and exhaust valves 54*a* and 54*b*.

Thus, rotational motion of the exhaust camshaft 140 and exhaust cam lobes 141 may be converted into translational motion of the exhaust valves 54*a* and 54*b*. Each of the cam lobes 141 may be in communication with an exhaust tappet 143 and exhaust valve spring 145 for adjusting the position of the exhaust valves. Specifically, each of the cam lobes 141 may be in face-sharing contact with an exhaust tappet 143, and as the camshaft 140 and cam lobes 141 rotate, the tappet 143, spring 145, and exhaust valve 54*a* may be displaced according to the lift profile of the cam lobe. Although camshaft 140 and cam lobes 141 are shown to be in communication with tappets and springs of corresponding exhaust valves, it should be appreciated that in other embodiments, the exhaust valves 54*a* and 54*b* may be actuated by additional components such as push rods, rocker arms, etc. In still further embodiments, camshaft 140 and cam lobes 141 may not be in communication with one or more of the tappets and springs, and may instead be in communication with push rods, rocker arms, etc. for actuating the exhaust valves 54*a* and 54*b*. Further still, various combinations of springs, push rods, tappets, rocker arms, etc. may be used for converting the rotational motion of the camshaft 140 and cam lobes 141 into translational motion of the exhaust valves 54*a* and 54*b*.

The exhaust valves may also be actuated via additional cam lobe profiles on the camshafts, where the cam lobe profiles between the different valves may provide varying cam lift height, cam duration, and/or cam timing. However, alternative camshaft (overhead and/or pushrod) arrangements could be used, if desired.

Camshaft 140 may be hydraulically coupled to housing 146. Housing 146 may form a toothed wheel having a plurality of teeth 21, 22, 23, 24, and 25. While in the depicted example, housing 146 may comprise 5 teeth, it should be appreciated that in other examples, housing 146 may include more or less than 5 teeth. In one example, as in a four stroke engine, for example, housing 146 and crankshaft 40 may be mechanically coupled to camshaft 140 such that housing 146 and crankshaft 40 may synchronously rotate at a speed different than camshaft 140 (e.g., a 2:1 ratio, where the crankshaft rotates at twice the speed of the camshaft). In such examples, teeth 21, 22, 23, 24, and 25 may be mechanically coupled to camshaft 140. By manipulation of the hydraulic coupling as described herein, the relative position of camshaft 140 to crankshaft 40 can be varied by hydraulic pressures in retard chamber 142 and advance chamber 144. By allowing high pressure hydraulic fluid to enter retard chamber 142, the relative relationship between camshaft 140 and crankshaft 40 may be retarded. Thus, exhaust valves 54*a*, 54*b* may open and close at a time later than normal relative to crankshaft 40. Similarly, by allowing high pressure hydraulic fluid to enter advance chamber 144, the relative relationship between camshaft 140 and crankshaft 40 may be advanced. Thus, exhaust valves 54*a*, 54*b*, may open and close at a time earlier than normal relative to crankshaft 40. However, in other examples, housing 146 may be mechanically coupled to crankshaft 40 via a timing chain or belt for rotating housing 146 and camshaft 140 at a speed substantially equivalent to each other and synchronous to the crankshaft 40.

Continuing with actuation of the exhaust valves 54*a* and 54*b*, teeth 21 22, 32, 24, and 25, rotating synchronously with camshaft 140, may allow for measurement of relative cam position via cam timing sensor 148 providing signal VCT to controller 12. Specifically, teeth 21, 22, 23, and 24 may be used for measurement of cam timing and may be equally spaced (for example, in a V-8 dual bank engine, spaced 90 degrees apart from one another) while tooth 25 may be used for cylinder identification. Thus, outputs from the cam timing sensor 148 may be received by the controller 12 and used to estimate the position and/or timing of the camshaft 140. In addition, controller 12 sends control signals (LACT, RACT) to conventional solenoid valves (not shown) to control the flow of hydraulic fluid either into retard chamber 142, advance chamber 144, or neither.

Relative cam timing can be measured in a variety of ways. In general terms, the time, or rotation angle, between the rising edge of the PIP signal and receiving a signal from one of the plurality of teeth 21, 22, 23, 24, and 25, on housing 146 gives a measure of the relative cam timing. For the particular example of a V-8 engine, with two cylinder banks and a five-toothed wheel, a measure of cam timing for a particular bank is received four times per revolution, with the extra signal used for cylinder identification.

While this example shows a system in which the intake and exhaust valve timing are controlled independently, it should be appreciated that concurrent intake and exhaust valve timing, variable intake cam timing, variable exhaust cam timing, dual equal variable cam timing, or other variable cam timing techniques may be used. Further, variable valve lift may also be used. Further, camshaft profile switching may be used to provide different cam profiles under different operating conditions. Further still, the valvetrain may be roller finger follower, direct acting mechanical bucket, electrohydraulic, or rocker arms.

Figure 2:
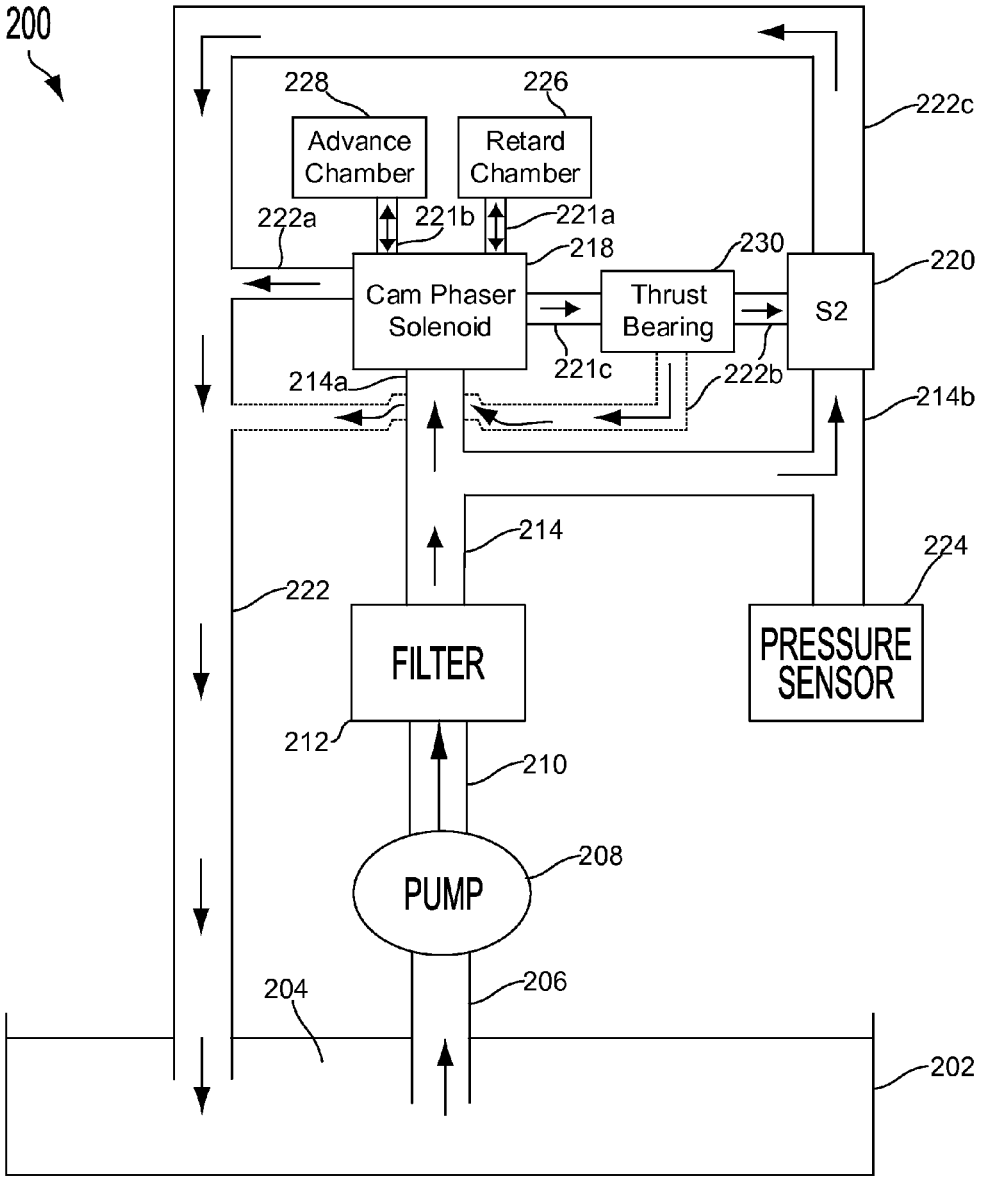
FIG. 2 shows a block diagram of an engine oil lubrication system.
Figure 3A:
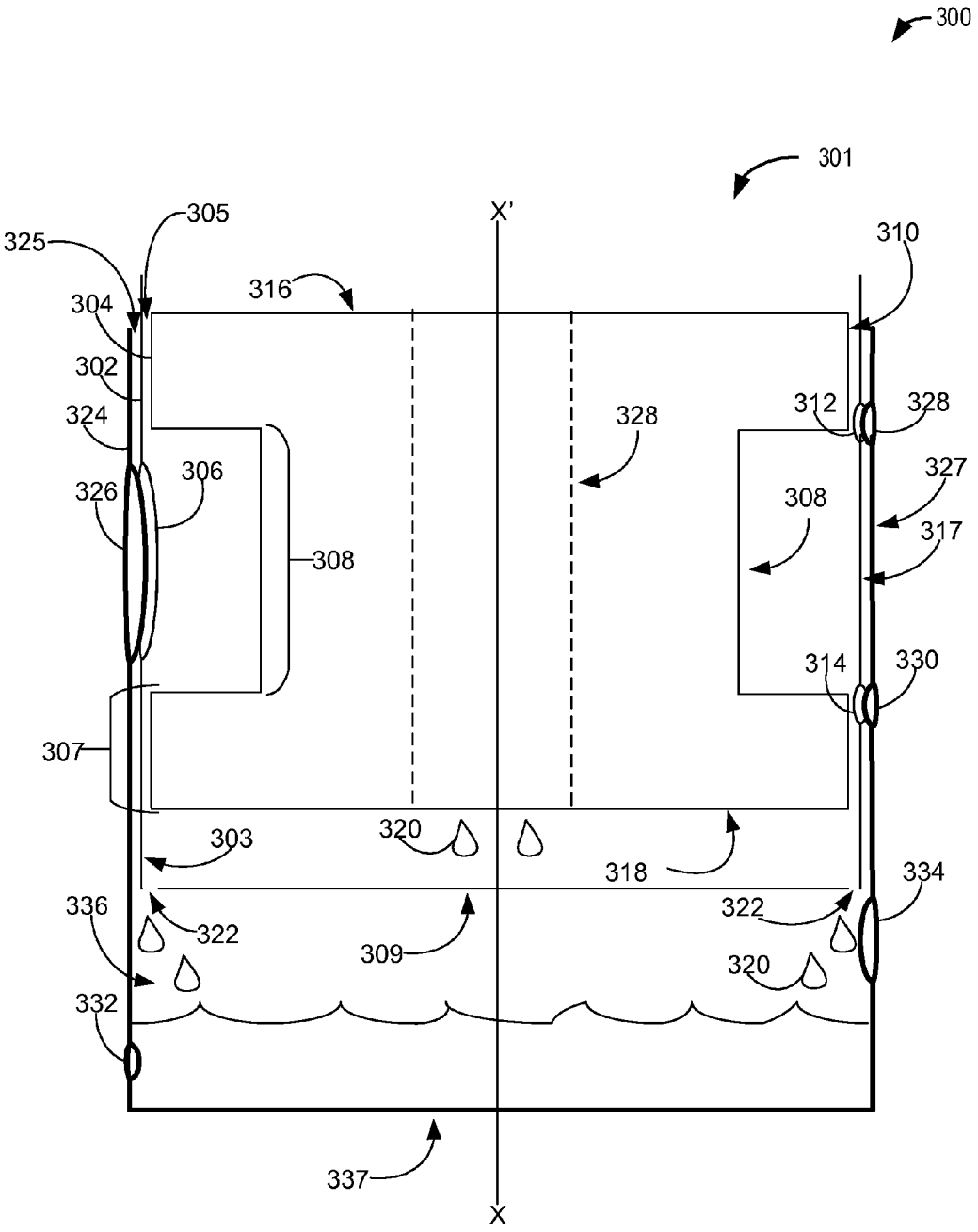
FIG. 3A shows a schematic diagram of an oil control valve which may be used in a variable cam timing system, in a holding position.
Figure 3B:
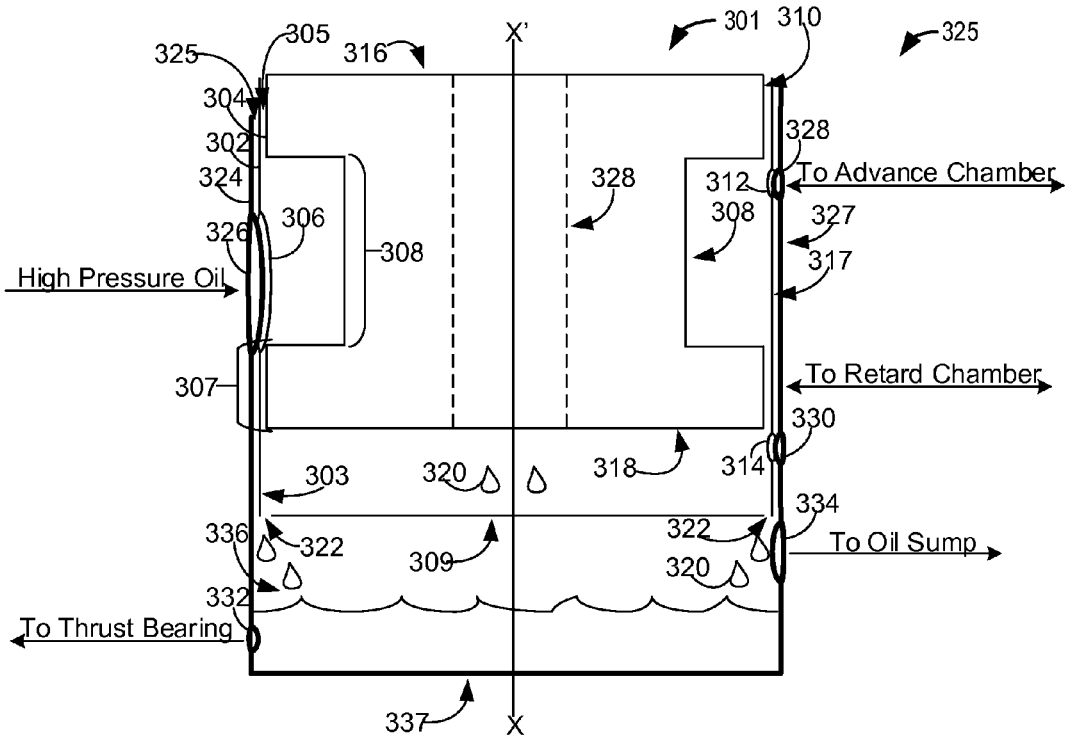
FIG. 3B shows a schematic diagram of an oil control valve which may be used in a variable cam timing system, in an advanced position.
Figure 3C:
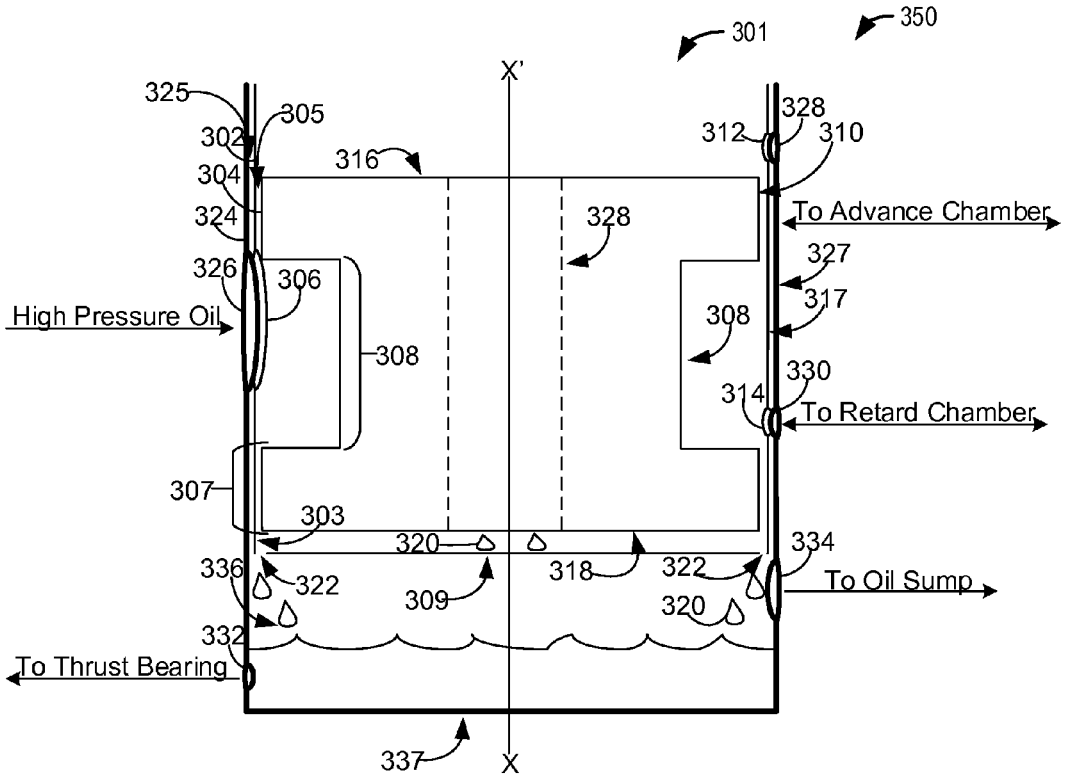
FIG. 3C shows a schematic diagram of an oil control valve which may be used in a variable cam timing system, in a retarded position.

FIG. 2 shows an example embodiment of an engine oil lubrication system 200 with an oil pump 208 which may be powered by a rotating crankshaft (e.g., crankshaft 40 shown in FIG. 1) via a mechanical linkage (e.g., drive belt or chain). Therefore, in some examples, pump 208 may be an engine driven pump, where the pump output may be higher at higher engine speeds and lower at lower engine speeds. However, in other examples, the pump 208 may include its own dedicated power source such as a battery or generator, and pump output may be independent of engine speed. The engine oil lubrication system 200 may including various oil subsystems such as subsystem (S2) 220. The oil subsystem 220 may utilize oil flow to perform some function, such as lubrication, actuation of an actuator, etc. For example, the oil subsystem 220 may include hydraulic systems with hydraulic actuators and hydraulic control valves. Further, the subsystem 220 may include lubrication systems, such as passageways for delivering oil to moving components, such as the crankshaft, cylinder valves, etc. In still further examples, the subsystem 200 may include cylinder walls, miscellaneous bearings, etc. In some embodiments, there may be fewer or more than one oil subsystem as depicted in the example of FIG. 2. Oil lubrication system 200 may further include a cam phaser solenoid 218, which may regulate the flow of oil to a variable cam timing (VCT) system (e.g., VCT system 19 shown in FIG. 1). An example cam phaser solenoid is described in greater detail below with reference to FIGS. 4-8.

Continuing with FIG. 2, the oil pump 208, in association with rotation of the crankshaft, may suck oil from oil reservoir 204, stored in oil pan or oil sump 202, through supply channel 206. Oil may be delivered from oil pump 208 with pressure through supply channel 210 and oil filter 212 to main galley 214. From gallery 214, oil may flow to either the cam phaser solenoid 218 through supply channel 214*a* or the oil subsystem 220 through supply channel 214*b*. The pressure within the main galley 214 may be a function of the force produced by oil pump 208 and the flow of oil entering each of the oil subsystem 220 and the cam phaser solenoid 218 through supply channels 214*b* and 214*a*, respectively.

Oil entering the cam phaser solenoid 218 may be directed to either an advance chamber 228 or retard chamber 226 of the VCT system depending on the position of the cam phaser solenoid 218. Advance chamber 228 and retard chamber 226 may be the same or similar to advance chamber 134 and retard chamber 132, respectively, shown above with reference to FIG. 1. As such, the cam phaser solenoid 218 may be adjusted to regulate the flow of oil to either the advance chamber 228 or the retard chamber 226 depending on a desired camshaft position. Thus, the relative position between a camshaft (e.g., camshafts 130 and 140 shown in FIG. 1) and a crankshaft (e.g., crankshaft 40 shown in FIG. 1) may be adjusted by regulating oil flow to the advance chamber 228 and retard chamber 226. Thus, oil may flow between the retard chamber 226 and the cam phaser solenoid 218 via first VCT supply channel 221*a*, and between the advance chamber 228 and the cam phaser solenoid 218 via second VCT supply channel 221*b*. Further, oil flow in first VCT supply channel 221*a* and second VCT supply channel 222*b* may be bidirectional, where the direction of oil flow may depend on the position of the cam phaser solenoid 218 as shown in greater detail below with reference to FIGS. 3A-3C.

Upon a commanded camshaft movement to a more advanced position, oil may be directed from the solenoid 218 to the advance chamber 228. Displaced oil from the retard chamber 226 may return to the solenoid 218 during the transition to the more advanced camshaft position. Specifically, as the volume of the advance chamber increases and the volume of the retard chamber 226 decreases due to the increased oil flow to the advance chamber 228, displaced oil in the retard chamber 226 may flow back to the solenoid 218. Similarly, when the camshaft is commanded to a more retarded position, oil may be directed from the solenoid 218 to the retard chamber 226. Displaced oil from the advance chamber 228 may return to the solenoid 218 during the transition to the more retarded camshaft position. Specifically, as the volume of the retard chamber 226 increases and the volume of the advance chamber 228 decreases due to the increased oil flow to the retard chamber 226, displaced oil in the advance chamber 228 may flow back to the solenoid 218.

Excess oil in the cam phaser solenoid 218 may drain into a collection reservoir (not shown in FIG. 2) of the cam phaser solenoid 218 before exiting the cam phaser solenoid 218. Oil collected in the collection reservoir may be directed through supply channel 221*c* to lubricate a thrust bearing 230 of the VCT system. The thrust bearing 230, may provide structural support and stability to a rotating camshaft of the VCT system. After lubricating the thrust bearing 230, oil may in one example be drained to the subsystem 220 via channel 222*b*. Specifically, oil may be directed from the thrust bearing 230 to the crankshaft of the subsystem 220. From the oil subsystem 220, oil may flow to return channel 222 via return channel 222*c*. Return channel 222 may return oil to the oil sump 202 at approximately atmospheric pressure. In another examples, oil may be directed from the thrust bearing 230, to the oil sump 202 directly without passing through the subsystem 220. Thus, in such examples, channel 222*b* may provide fluidic communication between the thrust bearing 230 and the return channel 222. As such, oil may flow from the thrust bearing 230 to the oil sump 202 via channels 222*b* and 222. Put more simply, oil may flow from the thrust bearing 230 to a crankshaft of the subsystem 220 before returning to the oil sump 202 via return channel 222, or may flow directly to the oil sump 202 via return channel 222 without passing through the subsystem 220.

If oil levels in the cam phaser solenoid 218 increase above a threshold, oil may drain from the cam phaser solenoid 218 to the return channel 222 and oil sump 202 via channel 222*a*. Thus, the cam phaser solenoid 218 may comprise four ports from which oil may flow to channels 221*a*, 221*b*, 221*c*, and 222*a*.

Oil may return to oil reservoir 204 at approximately atmospheric pressure through return channel 222. Oil pressure sensor 224 may be included in oil lubrication system 200 for measuring main galley oil pressure. Outputs from the pressure sensor 224 may be sent to a controller (e.g., controller 12 shown in FIG. 1) for estimating a pressure of oil in the main galley 214.

In this way, oil may be delivered to various rotating engine components. In some examples, the oil may be used for lubrication of moving parts. In other examples, the pressurized oil may be supplied to oil controlled actuation systems, such as a VCT system. Specifically, oil may be pumped to a cam phaser solenoid, for regulating a timing position of a camshaft. Oil provided to the cam phaser solenoid may be directed to either an advance chamber for advancing the camshaft timing, or to a retard chamber for retarding the position of the camshaft. Additionally, oil may drain from the cam phaser solenoid to a collection reservoir formed by the bottom of a housing containing the cam phaser solenoid.

From the collection reservoir, oil may be directed to a thrust bearing for lubrication thereof. Additionally, if oil levels in the collection reservoir exceed a threshold, oil may also be drained to an oil sump as shown in greater detail below with reference to FIGS. 3A-3C.

Turning now to FIGS. 3A-3C, they show schematic representations of a VCT oil control valve in varying positions. The VCT oil control valve may include a solenoid which may be energized to change the position of the control valve. As the control valve is adjusted to different positions, the flow of oil within a housing containing the valve may change. In some examples, the control valve may be adjusted to direct oil to either an advance or a retard chamber of a VCT system to adjust the relative timing of a camshaft. Specifically, FIG. 3A shows the oil control valve in a neutral first position, where approximately no oil may flow to either the retard or advance chambers. As such, the timing of the camshaft may be maintained in the current position with the oil control valve in the neutral first position. FIG. 3B, shows the oil control valve in an advanced second position, where oil flow to the advance chamber is increased relative to the neutral first position for advancing the position of the camshaft. The control valve may also be adjusted to a retarded third position, where oil flow to the retard chamber is increased relative to the neutral first position for retarding the position of the camshaft. It is important to note that while shown in only three positions in FIGS. 3A-3C, the VCT oil control valve may also be adjusted to any position between the advanced second position and the retarded third position.

Oil may drain from the VCT oil control valve and collect at the bottom of a housing containing the VCT oil control valve. The amount of oil draining from the VCT oil control valve may depend on the position of the valve. Oil may be directed from the bottom of the housing where oil collects to a thrust bearing for lubrication thereof. Further, if oil levels in the housing exceed a threshold, excess oil may be drained to an oil sump.

FIGS. 3A-3C depict a VCT oil control valve 301 housed within a vertical bore 324 of a cam journal cap, such as the cam journal cap 406 shown below with reference to FIGS. 4-8. As described below with reference to FIGS. 4-8, the cam journal cap may cover one or more camshafts (e.g., camshafts 130 and 140 shown in FIG. 1), and may provide oil to a phaser of a VCT system (e.g., VCT system 19 shown in FIG. 1), and to a camshaft thrust bearing for lubrication thereof. Specifically, FIGS. 3A-3C depict the oil control valve 301 in a variety of positions. The position of the VCT oil control valve 301 may be adjusted to regulate oil flow to the VCT system to adjust the position of the camshaft relative to a crankshaft (e.g., crankshaft 140 shown in FIG. 1). As such, the structure and components of the VCT oil control valve 301 may be described together, first. Following the structural description of the valve 301, will be a description of the oil flow within the valve 301 in the various positions shown in FIGS. 3A-3C. Thus, each of FIGS. 3A-3C will be discussed individually to highlight changes in the oil flow in the valve 301, as the position of the valve is changed.

Turning first to the structural description of the oil control valve 301, the valve 301 includes a valve body 302, and a valve spool 304. The spool 304 may be movable along the vertical axis X-X.' In the description herein, the terms "vertically above" and "vertically below" may be used to describe the relative positioning of components along the axis X-X.' Thus, a first component said to be vertically above a second component may be more proximate the X' end of the axis X-X' than the second component. Said another way, a first component said to be vertically below a second component may be more proximate the X end of the axis X-X.' Further, components vertically above may be positioned vertically above with respect to the ground when coupled in an on-road vehicle.

Thus, the spool 304 may slide up and down along axis X-X' within the valve body 302. A solenoid (not shown in FIGS. 3A-3C, may be physically coupled to the spool 304 for adjusting the position of the spool 304. Specifically, the solenoid may be energized with electrical pulses (e.g., pulse width modulated signal), where the electrical energy provided to the solenoid may be converted into translational movement of the spool 304 by the solenoid.

In some examples, the spool 304 and valve body 302 may be cylindrical. However, in other examples, the spool 304 and valve body 302 may take on other prismatic shapes such as rectangular. The spool 304 and valve body 302 may be shaped similarly or the same, so that the spool 304 fits within the valve body 302. As such, an outer edge 310 of the spool 304 may be curved. The spool 304 may comprise flanges 307 and an annular recess 308. Annular recess 308 may be inset from the flanges 307. As such, the circumference of the outer edge 310 of the spool 304 may not be uniform along the vertical extent of the spool 304. Thus, the spool 304 may be narrower at the annular recess 308 than at the flanges 307. While in the depicted example of FIGS. 3A-3C, only one recess 308 is shown, it should be appreciated that in other examples more than one recess 308 may be included in the spool 304.

In some examples, the outer edge 310 of the spool 304 at the flanges 307 may be in face sharing contact with interior surfaces 303 of side walls 317 of the valve body 302. Specifically, the outer edge 310 of the spool 304 at the flanges 307 may be in sealing contact with interior surfaces 303 of the side walls 317 valve body 302, so that substantially no oil may flow between the flanges 307 and side walls 317 of the valve body 302. However, in other examples, such as the examples shown in FIGS. 3A-3C, the flanges 307 and side walls 317 of the valve body 302, may not be in physical contact with one another, and may be spaced away from one another. Thus, a narrow gap 305 may be formed between the outer edge 310 of the spool 304 at the flanges 307 and interior surfaces 303 of the side walls 317 of the valve body 302. The flanges 307 may be spaced from the valve body 302 so that the gap 305 is sufficiently small to limit oil flow in the gap 305 to below a threshold. In some examples, the size of the gap 305 may range between 5-15 microns (μm).

The distance between the spool 304 and the valve body 302 at the recess 308, may be greater than at the flanges 307. As such, a greater volume of oil may be held between the annular recess 308 and the valve body 302, than in the gap 305 between the valve body 302 and the flanges 307. As such, oil flow in the valve 301 may be greater between the recess 308 and the valve body 302, than between the flanges 307 and the valve body 302. Said another way, the flanges 307 may act as flow restrictions that limit the amount of oil flowing into or out of the valve 301. Specifically, the flanges 307 may be positioned over one or more ports of the valve body 302 to restrict flow through the ports. On the other hand, the recess 308 may be positioned over one or more ports of the valve body 304 to enable higher oil flow through the one or more ports as will be described below.

High pressure oil may be delivered to the valve 301 from a pump (e.g., pump 208 shown in FIG. 2) of an oil system (e.g., oil lubrication system 200 shown in FIG. 2). Oil pumped to the valve 301 may enter valve 301 through a first port 306 on the valve body 302. The spool 304 is shown in the examples of FIGS. 3A-C, to be held in positions, where the annular recess 308 is positioned over the first port 306, for receiving oil from the first port 306. Oil may therefore be received by the valve 301 in the annular recess 308 between the spool 304 and valve body 302 of the valve 301. Thus, after passing through the first port 306, oil may flow into the recess 308 around a circumference of the spool 304. However, it should be appreciated that the spool 304 may also be adjusted to positions where the flanges 307 are positioned over first port 306, substantially blocking oil flow into the valve 301. Therefore, in some examples, the valve 301 may be adjusted such that oil flow into the valve 301 may be approximately zero.

A second port 312, may be included in the valve body 302 and may be positioned vertically above the first port 306. The second port 312 may be in fluidic communication with an advance chamber (e.g., advance chamber 134 shown in FIG. 1) of the VCT system. Further, a third port 314 may be included in the valve body 302, and may be positioned vertically below the first port 306. The third port 314 may be in fluidic communication with a retard chamber (e.g., retard chamber 132 shown in FIG. 1) of the VCT system. Although in some examples, as depicted in FIGS. 3A-3C, the second and third ports, 312 and 314, may be positioned opposite the first port 306, it should be appreciated that in other examples, the angular positioning of the first port 306, second port 312, and third port 314 relative to one another, and/or their vertical positioning may be different. For example, the first port 306, second port 312, and third port 314, may in some examples be aligned with one another along the vertical axis X-X.' In other examples, the ports 306, 312, and 314 may be parallel to one another with respect to the vertical axis X-X,' but may be vertically displaced with one another.

Oil may flow into and/or out of the valve 301 via the second port 312 and third port 314. The direction of oil flow through the second port 312 and third port 314 may depend on the position of the spool 304 within the valve body 302, and on the pressure differential between the advance and retard chambers of the VCT system and the valve 301. The direction of oil flow through the second and third ports 312 and 314, respectively, will be described in greater detail below when discussing the various operating positions of the valve 301.

The valve spool 304 may be vertically translated up and down along the vertical axis X-X' so that one of either the second port 312 or the third port 314 becomes more open, while the other port becomes more closed. The ports 312 and 314 may become more closed when one of the flanges 307 is adjusted to a position substantially covering the port. Thus, as shown in FIG. 3B, as the spool 304 is moved vertically upwards so that one of the flanges 307 is moved away from the second port 312 and the recess 308 is moved towards the second port 312, the other one of the flanges 307 may move towards the third port 314, substantially covering the third port 314. Conversely, as the spool 304 is moved vertically downwards as shown in FIG. 3C, so that one of the flanges 307 is moved away from third port 314 and the recess 308 is moved towards the third port 314, the other one of the flanges 307 may move towards the second port 312, substantially covering the second port 312. In this way, oil received from port 306 may continually be cycled to either the retard or advance chamber of the VCT system.

In examples where the flanges 307 are in sealing contact with the valve body, the amount of oil flowing between the valve body 302 and the flanges 307 may be approximately zero. Thus, in such examples, oil may be contained to within the recess 308. In other examples, where the flanges 307 are not in sealing contact with the valve body 302, such as depicted in the examples of FIGS. 3A-3C, a small portion of the oil in the recess 308 may flow around the outer edge 310 of the flanges 307 in the gap 305 formed between the flanges 307 and the valve body 302, and may drain to a bottom 309 of the valve body 302. Excess oil in the valve 301 that collects at the bottom 309 of the valve 301, may drain from the valve body 302, via one or more drainage apertures 322 positioned at the bottom 309 of the valve body 302. Thus, oil may exit the valve 301 via the drainage apertures 322 in the valve body 302.

Oil exiting from the valve 301 via the drainage apertures 322 may be collected in a collection reservoir 336 formed at a bottom 337 of the vertical bore 324, which houses the valve 301. In the description herein, bottom may refer to the vertical bottom with respect to the ground when coupled in an on-road vehicle. Thus, in some examples, flow around the flanges 307, between the valve body 302 and the flanges 307 may be greater than zero. In some examples therefore, the bottom 309 of the valve body 302 may not fluidically seal the interior of the valve 301 from the exterior of the valve 301, therefore allowing for excess oil in the valve 301 to be drained to the bottom 337 of the vertical bore 324. The vertical bore 324 however, may be closed at the bottom 337, and may fluidically seal the interior of the vertical bore 324 that houses the valve 301 from the exterior of the bore 324. In this way, the bottom 337 of the vertical bore 324 may form an oil collection reservoir 336 that collects oil drained from the valve 301. Any oil drained from the spool 304, may therefore be collected and held within the vertical bore 324. In the example of FIGS. 3A-3C, drained oil 320 is shown collecting at the bottom 337 of the vertical bore 324.

The spool 304 may be substantially hollow, so that a top 316 and bottom 318 of the spool 304 may be open. As such, oil may pass through the spool 304 from the top 316 to the bottom 318. In other embodiments, only a portion of the spool 304 may be hollow, and as such, only a portion of the top 316 and bottom 318 may be open. Specifically, a hollow passage 328 may be formed within the spool 304 for providing fluidic communication between the top 316 and bottom 318 of the spool 304. Oil at the top 316 of the spool 304, may therefore pass through the hollow interior of the spool 304, and drain to the bottom of the valve body 302 before exiting the valve 301 and collecting at the collection reservoir 336 as illustrated by the drained oil 320 in FIGS. 3A-3C.

As described above, the vertical bore 324 may form a housing for control valve 301. As such, the vertical bore 324 may also be referred to herein as a control valve housing 324. Specifically, the vertical bore 324 may house the valve body 302 of the control valve 301, the valve body 302 housing the spool 304. The vertical bore 324 may be fluidically sealed at the bottom 337, so that oil drained from the control valve 301, may collect in the collection reservoir 336 formed at the bottom 337 of the vertical bore 324.

Oil pumped to the vertical bore 324 and valve 301 may enter the vertical bore 324 through a first port 326. The position of the valve body 302 of the valve 301 may be fixed within the vertical bore 324. That is to say, the valve body 302 may not move in the vertical direction along the axis X-X' relative to the vertical bore 324. However, the spool 304, may move along the vertical axis X-X,' and thus, the position of the spool 304 relative to the valve body 302 and vertical bore 324 may be adjusted to regulate oil flow into and out of the valve 301 and/or vertical bore 324. Thus, in the description herein, movement of adjusting of the position of the valve 301, may be used to refer to movement of adjusting of the position of the spool 304 along the vertical axis X-X.'

After entering the vertical bore 324 through the first port 306, a larger first portion of oil may flow into the valve 301 via the first port 306 of the valve body 302 as explained above. Additionally or alternatively, a smaller second portion of oil may drain to the collection reservoir 336 via a drainage gap 325 formed between side walls 317 of the valve body 302 and side walls 327 of the vertical bore 324.

As explained above, the position of the valve body 302 may be fixed relative to the vertical bore 324. As such, exterior surfaces of the side walls 317 of the valve body 302 may be separated from interior surfaces of the side walls 327 of the vertical bore 324 by a distance of anywhere in a range between 10 to 25 microns (μm) forming the gap 325 between the side walls 317 of the valve body 302 and the side walls 327 of the vertical bore 324. However, it should be appreciated that in some examples, the side walls 327 of the vertical bore 324 and the side walls 317 of the valve body 302 may not be separated by the gap 325, and instead may be in face sharing contact with one another, so that exterior surface of the side walls 317 directly and physically contact the interior surfaces of the side walls 327. In such examples, the side walls 317 and side walls 327 may be in sealing contact with one another, and as such oil may not drain to collection reservoir 336 by flowing between the valve 301 and the vertical bore 324. In such examples, the second portion of oil may be approximately zero, and all of the oil entering the vertical bore 324 through the first port 306 may pass into the valve 301 via the first port 306 of the valve body 302.

Further, since the positions of the valve body 302 and vertical bore 324 may be fixed relative to one another, the first port 306 of the valve body 302, and the first port 326 of the vertical bore 324 may be vertically aligned with one another along the axis X-X.' Further, the ports 306 and 326 may be at the same angular position. In this way, the first port 326 of the vertical bore 324 may be sized and shaped the same or similar to the first port 306 and may be positioned directly over the first port 306 of the valve body 302, so that oil flowing through the first port 326, may then proceed directly into the valve 301 via the first port 306 in the valve body 302. Said another way, the edges of the ports 306 and 326, that define their hollow openings through which oil may pass, may be aligned with one another, so that oil may flow in a substantially straight line through the first port 326 of the vertical bore 324 to the first port 306 of the valve body 302, and into the interior of the valve body 302 via the port 306.

A second port 328, may be included in the vertical bore 324 and may be positioned vertically above the first port 326. The second port 328 of the vertical bore 324 may be in fluidic communication with the advance chamber of the VCT system, and with the second port 312 of the valve body, for providing fluidic communication there-between. Since the positions of the valve body 302 and vertical bore 324 may be fixed relative to one another, the second port 312 of the valve body 302, and the second port 328 of the vertical bore 324 may be vertically aligned with one another along the axis X-X.' Further, the ports 312 and 328 may be at the same angular position. In this way, the second port 328 of the vertical bore 324 may be sized and shaped the same or similar to the second port 312, and may be positioned directly over the second port 312 of the valve body 302, so that oil flowing out of the valve 301 via the second port 312, may then proceed directly out the vertical bore 324 to the advance chamber via the second port 328 in the vertical bore 324. However, it should be appreciated that in other examples, the second port 328 of the vertical bore 324 may be sized larger or smaller than the second port 312 of the valve body 302. Specifically, the second port 328, may be sized to larger than the second port 312.

In some examples, the second port 312 may be sized sufficiently small so that oil flow from within the valve body 302, to the advance chamber may be restricted by the second port 328. However, when oil flows from the advance chamber back to the vertical bore 324, such as during a movement of the valve 301 to a more retarded position, displaced oil returning the vertical bore 324 may not be restricted via the larger opening of the second port 328 relative to the second port 312 of the valve body 302.

In examples where the ports 328 and 312 are approximately the same size, the edges of the ports 312 and 328, that define their hollow openings through which oil may pass, may be aligned with one another, so that oil may flow in a substantially straight line through the second port 312 of the valve body 302 to the second port 328 of the vertical bore 324, and out of the vertical bore 324 via the second port 328. Thus, the ports 328 and 312 may be centered on one another, in some examples. However, it should be appreciated that in other examples, the ports 328 and 312 may be off-centered from one another. It should also be appreciated that oil may flow into and/or out of the vertical bore 324 via the second port 328. Additionally, oil may flow into and/or out of the valve 301 via the second port 312. The direction of oil flow in the second ports 312 and 328 may depend on the position of the spool 304, and oil pressures in the advance and retard chambers of the VCT system.

Further, a third port 330 may be included in the valve body 302, and may be positioned vertically below the first port 306. The third port 330 may be in fluidic communication with the retard chamber of the VCT system, and with the third port 314 of the valve body 302 for providing fluidic communication there-between. Since the positions of the valve body 302 and vertical bore 324 may be fixed relative to one another, the third port 314 of the valve body 302, and the third port 330 of the vertical bore 324 may be vertically aligned with one another along the axis X-X.' Further, the ports 314 and 330 may be at the same angular position. In this way, the third port 330 of the vertical bore 324 may be sized and shaped the same or similar to third port 314, and may be positioned directly over the third port 314 of the valve body 302, so that oil flowing out of the valve 301 via the second port 312, may then proceed directly out the vertical bore 324 to the advance chamber via the third port 330 in vertical bore 324. However, it should be appreciated that in other examples, the third port 330 of the vertical bore 324 may be sized larger or smaller than the third port 314 of the valve body 302. Specifically, the third port 330, may be sized to larger than the third port 314. In some examples, the third port 314 may be sized sufficiently small so that oil flow from within the valve body 302, to the retard chamber may be restricted by the third port 330. However, when oil flows from the retard chamber back to the vertical bore 324, such as during a movement of the valve 301 to a more advanced position, displaced oil returning the vertical bore 324 may not be restricted via the larger opening of the third port 330 relative to the third port 314 of the valve body 302.

In examples, where the ports 314 and 330 are sized approximately the same, the edges of the ports 314 and 330, that define their hollow openings through which oil may pass, may be aligned with one another, so that oil may flow in a substantially straight line through the third port 314 of the valve body 302 to the third port 330 of the vertical bore 324, and out of the vertical bore 324 via the third port 330. Thus, the ports 330 and 314 may be centered on one another, in some examples. However, it should be appreciated that in other examples, the ports 330 and 314 may be off-centered from one another. A portion of oil flowing out of the valve 301 towards the retard chamber through the third port 314, may also drain to the collection reservoir 336 via the gap 325. Thus, in some examples, not all of the oil flow out of the valve 301 through the third port 314 may exit the vertical bore 324 via the third port 330. Instead, some of the oil may flow down the gap 325, between the side walls 317 and 327, and may collect at the bottom 337 of the vertical bore 324. It should also be appreciated that oil may flow into and/or out of the vertical bore 324 via the second port 328. Additionally, oil may flow into and/or out of the valve 301 via the third port 314. The direction of oil flow through the third ports 314 and 330 may depend on the position of the spool 304, and oil pressures in the advance and retard chambers of the VCT system.

For example, turning to FIG. 3A, it illustrates a schematic 300 of the VCT oil control valve 301 in a neutral first position between the advanced and retarded positions shown below with reference to FIGS. 3B and 3C, respectively. The annular recess 308 of the spool 304 is positioned over the first port 306 for receiving oil. As such, oil may be flowing into the valve 301 in the neutral position shown in FIG. 3A. Flanges 307 may be positioned over a portion and/or all of the second port 312 and third port 314, partially and/or entirely blocking oil flow through the ports 312 and 314. In this way, the timing position of a camshaft regulated by the valve 301 may be relatively maintained when the valve 301 is in the neutral first position shown in FIG. 3A. In the neutral first position shown in FIG. 3A, some oil may flow through the ports 312 and 314. However, the amount of oil flowing out of the valve 301 through the port 312 when the valve 301 is in the neutral first position is less than the amount when the valve 301 is in an advanced position such as the advanced second position shown in FIG. 3B. Similarly, the amount of oil flowing out of the valve 301 through the port 314 when the valve 301 is in the neutral first position is less than the amount when the valve 301 is in a retarded position such as the retarded third position shown in FIG. 3C. When in the neutral first position, oil in the recess 308 of the spool 304, may drain to the bottom 309 of the valve body 302. Specifically, oil may either drain to the bottom 309 from the top 316 through the hollow passage 328, or, the oil may flow through the gap 305, between the outer edge 310 of the flanges 317 and the side walls 317 of the valve body 302. Internal oil in the valve 301 collected at the bottom 309 of the body 302, may then exit the valve 301 via apertures 322, and be collected in the collection reservoir 336.

Turning to FIG. 3B, it shows the spool 304 in an example advanced position 325, where the recess 308 is positioned over the second ports 312 and 328, and where the third ports 314 and 300 are positioned below the spool 304. Said another way, the spool 304 is moved vertically upwards to the advanced position 325, relative to the neutral position shown in FIG. 3A. Thus, the spool 304 may move vertically upwards from one or more of the neutral position or a more retarded position, to the advanced position 325, so that the recess 308 is positioned over the second ports 312 and 328, and so that the spool 304 is vertically above the third ports 314 and 330. Thus, the bottom 318 of the spool 304 may be vertically above the third ports 314 and 330. However, it should be appreciated that in other examples, the bottom 318 of the spool 304 may not be vertically above the third ports 314 and 330, and one of the flanges 307 may be positioned over the third ports 314 and 330. In this way, with the recess 308 positioned over the port 312, the pressure of oil in the valve 301 may cause oil to flow from inside the valve 301, out of the valve 301 through the second port 312. Oil may then proceed out of the vertical bore 324 via the second port 328, to the advance chamber of the VCT system due to the lower pressure in the advance chamber. Thus, the amount of oil flowing through the second ports 312 and 328 with the valve 301 in the advanced second position may be increased relative to the neutral first position shown in FIG. 3A. In this way, the timing position of a camshaft may be advanced by adjusting the valve 301 to the advanced second position. Specifically, by shifting the spool 304 up, and positioning the recess 308 over the second port 312, a distance between the outer edge 310 and the second port 312 may be increased relative to the neutral first position shown in FIG. 3A.

In this way, the position of a camshaft relative to a crankshaft may be advanced. It should also be appreciated that not all of the oil flowing out of the valve 301 through the second port 312 when the spool 304 is in the advanced position 325 may reach the second port 328 and/or exit the vertical bore 324 via the second port 328. Due to the high pressure of the oil in the valve 301, oil may flow vertically upwards, against the force of gravity through one or more of the gaps 305 and 325, and may reach the top 316 of the spool 314. This oil may then drain to the bottom 318 of the valve body 302 via the hollow passage 328 in the spool 304 as indicated by the drained oil 320. In still further examples, due to gravity, a portion of oil flowing out of the valve 301 through the second port 312 may drain downwards in the gap 325 between the side walls 317 and 327, and may reach the collection reservoir 336 directly, without passing through the valve 301 first, as is the case when the oil flow upwards to the top 316 of the spool 304.

When the spool 304 is adjusted to the advanced position 325 where the recess 308 is positioned over the ports 312 and 328, providing fluidic communication between the valve 301 and the advance chamber, displaced oil in the retard chamber may flow back towards the vertical bore 324. As oil is provided to the advance chamber, and oil levels in the advance chamber increases, oil in the retard chamber may be forced out of the retard chamber, and may flow back towards port 330 of the vertical bore 324. A portion of this displaced oil may flow back into the valve 301 by flowing first through the third port 330 of the vertical bore 324, and then through the third port 314 of the body 302 of the valve 301. However, some of the displaced oil returning from the retard chamber, may drain to the collection reservoir 336 by passing through the third port 330 of the vertical bore 324, and then flowing through the gap 325 formed between the valve 301 and the vertical bore 324. Thus, at least a portion of the displaced oil returning from the retard chamber, may enter the vertical bore 324 via the third port 330, but may not enter the valve 301. Instead, this oil may drain to the collection reservoir 336 through the gap 325 due to gravity. In this way, oil draining from the retard chamber back to the vertical bore 324, may be collected in the collection reservoir 336 of the vertical bore 324.

Further, since the spool 304 may be positioned vertically above the third port 314, displaced oil from the retard chamber may enter the valve body 302 via the third port, and may be drain directly to the bottom 309 of the valve body 302. Oil at the bottom 309 of the valve body 302 may then drain and collect in the collection reservoir 336 via the apertures 322. Thus, displaced oil from the retard chamber and entering the vertical bore via the third port 330 may drain directly to the collection reservoir 336 via the gap 325 and/or may drain to the collection reservoir 336 after passing back into the valve body 302 through the third port 314 and then draining from the valve body 302 via the apertures 322.

A similar oil flow configuration applies when the spool 304 is adjusted to a retarded position. For example, turning to FIG. 3C, it shows the spool 304 in an example retarded position 350, where the recess 308 is positioned over the third ports 314 and 330, and where the second ports 312 and 328 are positioned above the spool 304. Said another way, the spool 304 is moved vertically downwards to a retarded position 350, relative to the neutral position shown in FIG. 3A. Thus, the spool 304 may move vertically downwards from one or more of the neutral position or a more advanced position, to the retarded position 350, so that the recess 308 is positioned over the third ports 314 and 300, and so that the spool 304 is vertically below the second ports 312 and 328. Thus, the top 316 of the spool 304 may be vertically below the second ports 312 and 328. However, it should be appreciated that in other examples, the top 316 of the spool 304 may not be vertically below the second ports 312 and 328, and one of the flanges 307 may be positioned over the second ports 312 and 328. In examples where one of the flanges 307 is positioned over the second ports 312 and 328, the spool 304 may restrict oil flow into and out of the valve 301 via the second port 312, but may provide fluidic communication between the valve 301 and the retard chamber.

In this way, with the recess 308 positioned over the port 314, the pressure of oil in the valve 301 may cause oil to flow from inside the valve 301, out of the valve 301 through the third port 314. Oil may then proceed out of the vertical bore 324 via the third port 330, to the retard chamber of the VCT system due to the lower pressure in the retard chamber. Thus, the amount of oil flowing out of the valve 301 through the third ports 314 and 300 with the valve 301 in the retarded third position 350 may be increased relative to the neutral first position shown in FIG. 3A. Specifically, by shifting the spool 304 vertically down, and positioning the recess 308 over the third port 314, a distance between the outer edge 310 of the spool 304 and the third port 314 may be increased relative to the neutral first position shown in FIG. 3A.

The position of a camshaft relative to a crankshaft may therefore be retarded with the spool 304 in the retarded position 350 shown in FIG. 3C. It should also be appreciated that not all of the oil flowing out of the valve 301 through the third port 314 when the spool 304 is in the retarded position 350 may reach the third port 330 of the vertical bore 324 and/or exit the vertical bore 324 via the third port 330. Due to gravity and/or the high pressure of oil in the valve 301, a portion of oil flowing out of the valve 301 through the third port 314 may drain downwards in the gap 325 between the side walls 317 and 327, and may reach the collection reservoir 336. In another example, due to gravity and/or the high pressure of oil in the valve 301, a portion of oil in the valve 301 may flow through the downwards through the gap 305 to the bottom 309 of the valve body 302, and subsequently may exit the valve body 302 via the drainage apertures 322, and may then collect in the collection reservoir 336.

When the spool 304 is adjusted to the retarded position where the recess 308 is positioned over the ports 314 and 330, providing fluidic communication between the valve 301 and the retard chamber, oil in the advance chamber may flow back towards the vertical bore 324. As oil is provided to the retard chamber, and oil levels in the retard chamber increases, oil in the advance chamber may be forced out of the advance chamber, and may flow back towards port 328 of the vertical bore 324. A portion of this displaced oil may flow back into the valve 301 by flowing first through the second port 328 of the vertical bore 324, and then through the second port 312 of the body 302 of the valve 301. Since the top 316 of the spool 304 may be below the second ports 312 and 328 when in the retarded position, oil flowing into the valve body 302 via the second port 312 may drain to the bottom of the spool 304 via the hollow passage 328 and then exit the spool 304 to the bottom 309 of the valve body 302. Said another way, displaced oil from the advance chamber may flow back into the valve 301, and may enter the hollow passage 328 of the spool 304 at the top 316 of the spool 304. Displaced oil from the advanced chamber may then drain to the collection reservoir 336 via the apertures 322 in the valve body 302 after flowing through the hollow passage 328 of the spool 304. Thus, displaced oil returning to the valve 301 from the advance chamber when the valve 301 is adjusted to the retarded position, may naturally drain to the bottom of the valve 301 via the hollow passage 328 in the spool 316 since the spool 304 may be positioned vertically below the second ports 312 and 328.

However, displaced oil returning from the advance chamber, may additionally or alternatively drain to the collection reservoir 336 by passing through the second port 328 of the vertical bore 324, and then flowing vertically downwards through the gap 325 formed between the valve 301 and the vertical bore 324. In this way, oil draining from the advance chamber back to the vertical bore 324, may be collected in the collection reservoir 336 of the vertical bore 324. However, it should be appreciated that the oil flow rate of displaced oil from the advance chamber to the top 316 of the spool 304 may be greater than that through the gap 325. Thus, more oil may drain to the collection reservoir 336 via the hollow passage 328 of the spool 304, and apertures 322 of the valve body 302, than via the gap 325 when the valve 301 is in the retarded position 350.

In some examples, where one of the flanges 307 is positioned over the second ports 312 and 328 in the retarded position 350, because the spool 304 may positioned to restrict flow into or out of the second port 312 when in the retarded position, a portion of the oil returning from the advance chamber may be forced vertically upwards, against the force of gravity through one or more of the gaps 305 and 325, and may reach the top 316 of the spool 314. Thus, the positioning of the spool 314 in the retarded position 350 may cause a flow restriction between at the second ports 312 and 328, which may force displaced oil returning from the advance chamber to flow vertically upwards or downwards through gap 325 between the valve body 302 and the vertical bore 324. Specifically, positioning one of the flanges 307 over the second port 312, may reduce the distance between the outer edge 310 and the wall 317, therefore increasing pressure and/or flow restriction through the second ports 312 and 328. Oil reaching the top of the spool 304, may then drain to the bottom 318 of the valve body 302 via the hollow passage 328 in the spool 304 as indicated by the drained oil 320.

In this way, by adjusting the position of the spool 304, oil flow to and from the advance and retard chambers may be adjusted. A portion of any oil flowing into and/or out of the vertical bore 324 may drain downwards due to one or more of the force of gravity and pressure gradients, to the bottom 337 of the vertical bore 324 via the gap 325 formed between the side walls 317 of the valve body 302 and the side walls 327 of the vertical bore 324. Specifically, when high pressure oil is exiting the valve 301 en route to the advance chamber via port 312, due to the high pressure of the oil, some of the oil may be forced through the gap 325 either vertically upward towards the top of the spool 304, or vertically downwards towards the collection reservoir 336. Lower pressure oil returning from the retard chamber, may drain to the collection reservoir 336 via gap 325 due to the force of gravity. Similarly when the spool 304 is moved to the retarded position and high pressure oil is exiting the valve 301 en route to the retard chamber via port 314, due to the high pressure of the oil, some of the oil may be forced through the gap 325 either vertically upward towards the top of the spool 304, or vertically downwards towards the collection reservoir 336. Lower pressure oil returning from the advance chamber, may drain to the collection reservoir 336 via gap 325 due to the force of gravity.

Further, under sufficiently high pressures, a portion of any oil flowing between the valve 301 and the vertical bore 324 may flow upwards through the gap 325 against the force of gravity, and may reach the top 316 of the spool 304. Additionally or alternatively, under sufficiently high valve oil pressures, oil may reach the top of the spool 304, by flowing upwards through the gap 305 formed between the flanges 307 of the spool 304 and the side walls 317 of the valve body 302. Oil may then drain to the bottom of the valve body 302 through the passage 328 of the spool 304, and may then exit the valve 301 via the apertures 322 on the bottom 309 of the valve body 302, before being collected in the collection reservoir 336 of the vertical bore 324.

However, it should be appreciated, that the oil flow rate to the collection reservoir 336 may be higher when the valve 301 is adjusted to a more advanced position. Specifically, because the spool 304 may be adjusted to be vertically above the third ports 314 and 330 in the retarded position 350, displaced oil from the retard chamber may flow in a relatively unrestricted manner, directly to the collection reservoir 336 via one or more of the third ports 314 and 300. However, when the valve is adjusted to the neutral position, oil flow to the collection reservoir 336 may be lower than when in the advanced position. Further, oil flow to the collection reservoir 336, may be lower when the valve 301 is in the retarded position than in the advanced position, but higher than in the neutral position. Displaced oil from the advance chamber may be forced to flow through the spool 304 before draining to the bottom of the valve body 302 and then to the collection reservoir 336 when in the retarded position. Thus, oil flow rates may be higher when the valve 301 is adjusted to the advanced position 325 where the third ports 314 and 330 may be vertically below the spool 304, and/or the retarded position where the second ports 312 and 328 may be vertically above the spool 304. Said another way, the spool 304 may be vertically moved, so that in the advanced and retarded positions, either the second ports 312 and 328, or the third ports 314 and 330 are not covered by the spool 304, and as such displaced oil from either the advance or retard chambers may flow back into the valve 301 in a relatively unrestricted manner and drain to the collection reservoir 336.

As oil collects in the collection reservoir 336, oil may exit the vertical bore 324 via a drain port 334 integrally formed within the vertical bore 324 when the oil level in the collection reservoir 336 increases above a threshold. Drain port 334 may be in fluidic communication with an oil sump (e.g., oil sump 202 shown in FIG. 2). Thus, oil may be returned to the oil sump and oil lubrication system via the drain port 334. The drain port 334 may be positioned vertically below the third port 330. Further, the drain port 334 may be vertically positioned on the vertical bore 324 so that oil only flows out of the drain port 334 when oil levels exceed the threshold. The threshold oil level, may be approximately 25 mm. However, in other examples, the threshold may be greater of less than 25 mm. That is, the vertical distance between the bottom 337 of the vertical bore, and the drain port 334 may be approximately 25 mm.

The valve 301 may be vertically positioned within the vertical bore 324, so that the bottom 309 of the valve body 302 is vertically above the threshold oil level and the drain port 334. Said another way, the drain port 334 may be positioned vertically below the bottom 309 of the valve body 302. By including the drain port 334 vertically below the valve 301, oil levels in the collection reservoir 336 may be maintained below levels which would submerge any portion of the valve body 302. Thus, oil levels in the bottom of the vertical bore 324 may be kept below levels which would reach the bottom 309 of the valve body 302. When oil levels reach the vertical height of the drain port 334, oil may flow in a relatively unrestricted manner out of the vertical bore 324 via the drain port 334. The drain port 334, may therefore enable relatively unrestricted oil flow out of the vertical bore 324. In this way, oil levels may be kept to below the threshold.

A fourth port 332 may be included in the vertical bore 324 and may be positioned vertically below the drain port 334, proximate the bottom 337 of the vertical bore 324. The fourth port 332 may be positioned within the vertical bore 324, so that oil may continually exit the vertical bore 324 through the fourth port 332. Said another way, the fourth port 332 may be positioned in the vertical bore 324 such, that it is always submerged in oil. Further, the fourth port 332 may be submerged in oil when oil levels are less than the threshold so that oil may exit the fourth port 332 and not the drain port 334 when oil levels are below the threshold. However, when oil levels are greater than the threshold, oil may exit the vertical bore 324 from both the fourth port 332 and the drain port 334. Thus, the fourth port 332 and drain port 334 may be hydraulically in parallel to one another, such that oil may flow out of the valve 301 through both the drain port 334 and the fourth port 332, simultaneously, when oil levels in the collection reservoir 336 are greater than the threshold so that both the fourth port 332 and drain port 334 are submerged in oil. As shown in the examples of FIGS. 3A-3C, the fourth port 332 and drain port 334 may be positioned opposite one another on the vertical bore 324. Said another way, the drain port 334 and fourth port 332 may be diametrically opposed to one another such, that they are spaced approximately 180 degrees from one another around the circumference of the vertical bore 324. However, in other examples, the drain port 334 and fourth port 332 may be spaced from one another at a central angle of less than 180 degrees.

The fourth port 332 may be in fluidic communication with a thrust bearing (shown below with reference to FIG. 8) of a camshaft (e.g., camshaft 130 shown in FIG. 1) for lubrication thereof. Thus, oil may be continually be provided to the thrust bearing for consistent lubrication of the thrust bearing during both lower and higher oil flow levels from the valve 301. However, the fourth port 332 may be sized to limit the flow of oil to the thrust bearing to below a threshold flow rate. The threshold flow rate may represent an oil flow rate above which may result in the fourth port 332 no longer being submerged in oil. Thus, the threshold flow rate may represent an oil flow rate which if exceeded, may cause oil levels in the collection reservoir 336 to decrease vertically below the fourth port 332, so that oil may no longer flow out of the fourth port 332. However, in some examples, the fourth port 332 may be positioned at the bottom 309 of the valve body 302, so that as long as a non-zero amount of oil is collected at the bottom 309 of the valve 301, oil will flow out of the fourth port 332 to the thrust bearing. Put more simply, the fourth port 332 may be sized sufficiently small so that it allows oil to flow to the thrust bearing without causing oil levels in the collection reservoir 336 to decrease below a level which interrupt the flow of oil to the thrust bearing Further, the drain port 334 may be bigger than the fourth port 332, so that the flow rate out of the drain port 334 may be higher than the flow rate out of the fourth port 332, when oil levels in the collection reservoir 336 exceed the threshold oil level. Said another way, when the drain port 334 is submerged in oil, the oil level in the collection reservoir 336 may decrease at a faster rate than when only the fourth port 332 is submerged in oil, because the drain port 334 may be larger than the fourth port 332, and may allow for greater flow rates there-through. In this way, when oil levels in the collection reservoir 336 exceed the threshold, oil may be drained from the valve 301 more quickly than with only the smaller sized fourth port 332 included. As such, draining of excess oil during higher oil flow conditions may be improved by providing the drain port 334 above the fourth port 332. Additionally, by positioning the drain port 334 vertically above the fourth port 332, oil may only flow out of the drain port 334 when oil levels exceed the threshold, thereby ensuring that oil levels may remain sufficiently high to provide consistent lubrication to the thrust bearing via the fourth port 332.

It should be appreciated that in some examples, the vertical bore 324 may not include the drain port 334. In such examples, the size of the fourth port 332 may be increased, such that it does not act as a flow restriction. Thus, in examples, where the drain port 334 is not included in the vertical bore 324, the fourth port 332 may be sized to allow relatively unrestricted flow of oil out of the vertical bore 324.

In this way, oil flow to advance and retard chambers of a VCT system may be regulated by adjusting the position of a VCT oil control valve. Thus, the timing position of a camshaft controlled by the VCT system may be adjusted by adjusting the relative amount of oil flowing to the advance and retard chambers. Specifically, the position of a valve spool may be adjusted relative to a valve body to regulate oil flow into and out of the valve through one or more ports formed within the valve. Oil may flow into the valve via an inlet port of the valve. Further, oil may flow between the valve and the advance chamber via a second port of the valve, and between the valve and the retard chamber via a third port of the valve. Additionally, oil from one or more of the advance chamber and retard chamber may flow back into the valve. A portion of the oil flowing into the valve from one or more of the first, second, and third ports, may collect at the bottom of a vertical bore in a cam journal cap housing the control valve. The bottom of the vertical bore may therefore form a collection reservoir, which may accumulate with oil as oil is provided to the valve.

A fourth port may be positioned at or proximate the bottom of the vertical bore for flowing oil from the collection reservoir to a thrust bearing for lubrication thereof. A drain port may be positioned vertically above the fourth port fluidically coupled to the thrust bearing, for draining oil from the VCT chamber to an oil sump during movement of the control valve to advanced and retarded positions where flowrates between advance and retard chambers of the VCT system and the control valve are higher. In this way, by including the drainage port vertically above the fourth port the shifting rate of the valve body may be increased, degradation of the valve may be improved relative to valves only including a single, more flow restrictive port. Additionally, by including the fourth port at, or proximate the bottom of the vertical bore, consistent oil flow to the thrust bearing may be achieved. As a result lubrication, and therefore longevity of the thrust bearing may be increased. Example cam journal caps and their vertical bores which may house the control valve are shown below with reference to FIGS. 4-8.

Turning now to FIGS. 4-8, schematics of a cam journal cap with an integrated VCT oil control valve that may be included in a VCT system are shown. FIGS. 4-8 show the relative sizes and positions of the components within the VCT system, such as the VCT system 19 shown in FIG. 1. FIGS. 4-8 are drawn approximately to scale. Thus, in some examples, the relative sizing and positioning of the components shown in FIGS. 4-8 may represent the actual sizing and positioning of the components of the cam journal cap 406, camshafts 404 and 405, and cylinder head 402. However, in other examples, the relative sizing and position of the components may be different than shown in FIGS. 4-8.

FIGS. 4-8 show example configurations of the cam journal cap 406, camshafts 404 and 405, and cylinder head 402 with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space there-between and no other components may be referred to as such, in at least one example.

Further, components of cam journal cap 406 shown in FIGS. 4-8 may be the same or similar to components of the VCT system 19 shown in FIG. 1. Thus, components of the VCT system 19 already described above with regard to FIG. 1 may not be described in detail again below. Similarly, VCT oil control valves 410 and 411 may be the same as VCT oil control valve 301 shown above with reference to FIGS. 3A-3C. Thus, components of the VCT oil control valve 301 already described above with regard to FIGS. 3A-3C may not be reintroduced or described in detail again below. The cam journal cap 406 may be mounted on a dual independent overhead cam timing system such as VCT system 19.

Figure 4:
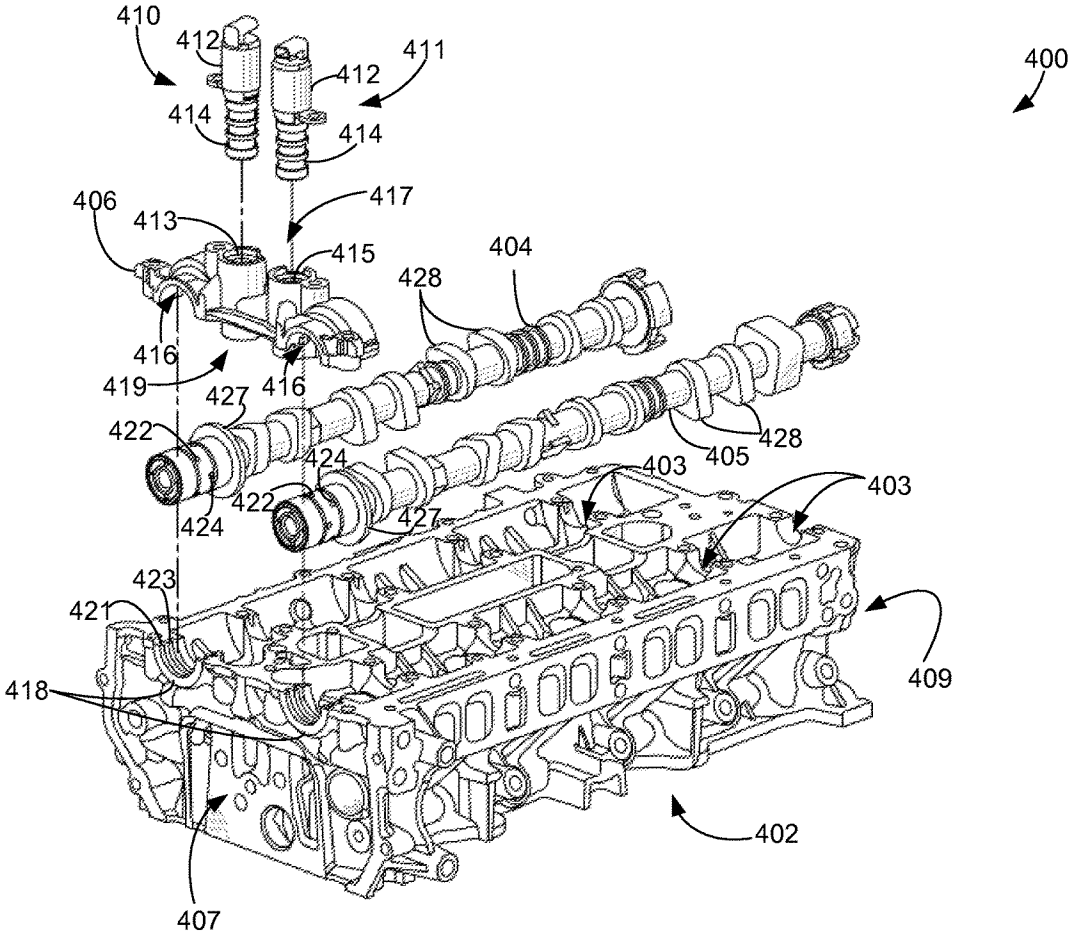
FIG. 4 illustrates an exploded view of an engine cylinder head including a cam journal cap.
Figure 5:
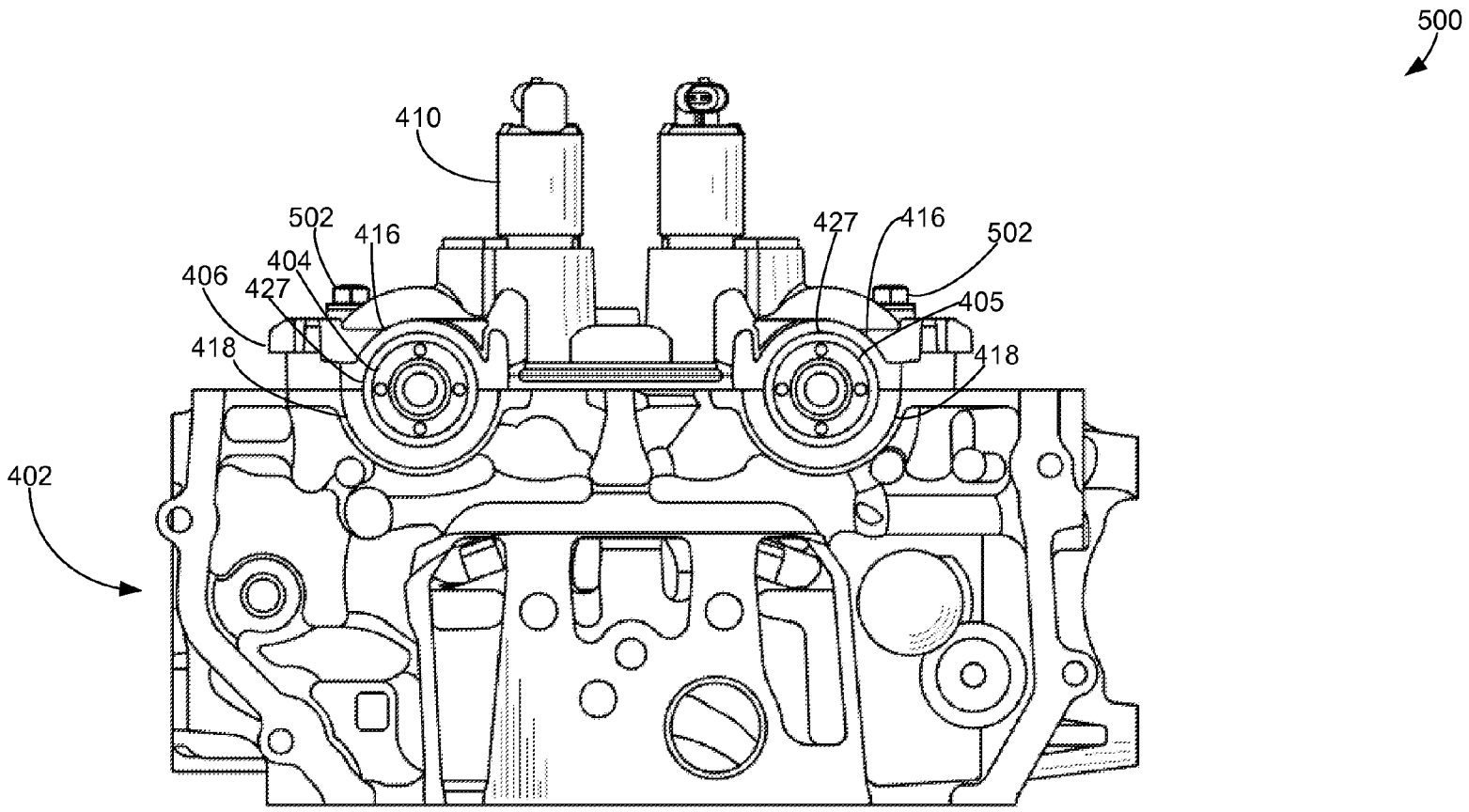
FIG. 5 illustrates a side view of the engine cylinder head and cam journal cap of FIG. 4.
Figure 6:
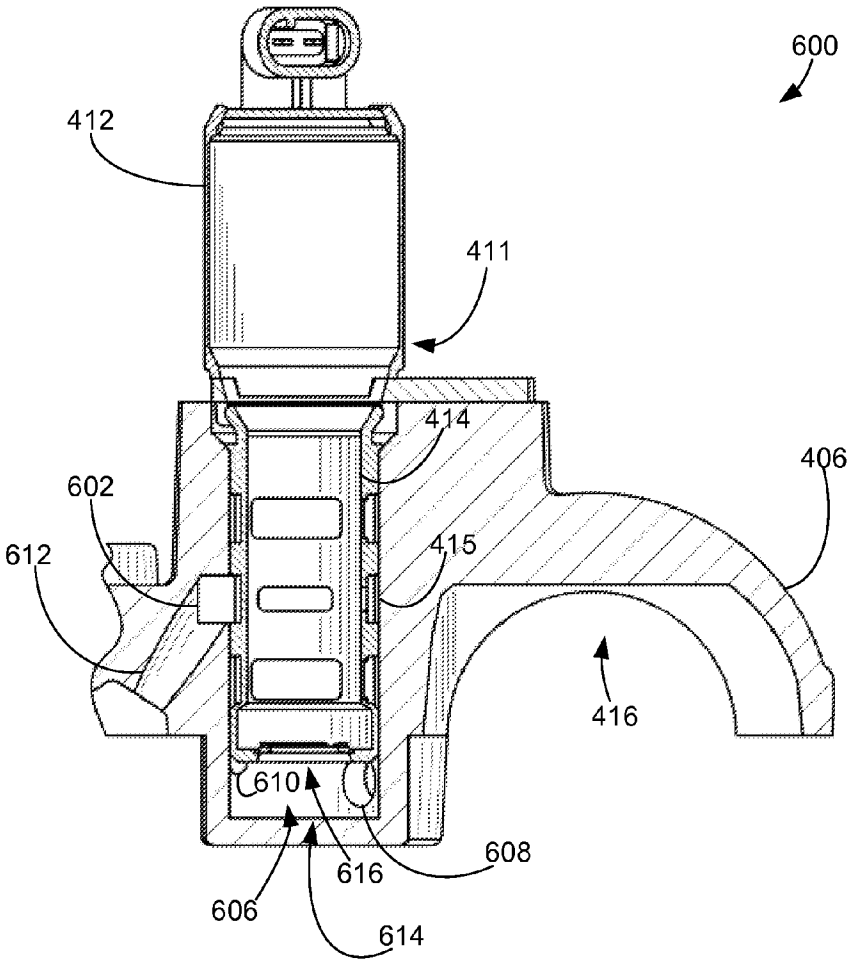
FIG. 6 illustrates a side perspective view of the cam journal cap of FIG. 4.

FIGS. 4-5 show the cam journal cap 406, as it may be included in a cylinder head 402 with camshafts 404 and 405. FIG. 4 is a first schematic 400 showing a first isometric exploded view of the cam journal cap 406, camshafts 404 and 405, and cylinder head 402. FIG. 5 is a second schematic 500 showing a side perspective view of the cam journal cap 406, camshafts 404 and 405, and cylinder head 402. FIGS. 6-8 show different perspective views of the cam journal cap 406 and its components. FIG. 6 is a third schematic 600 showing an external side perspective view of the cam journal cap 406. FIG. 7 is a fourth schematic 700 showing an internal side perspective view of the cam journal cap 406. FIG. 8 is a fifth schematic 800 showing a bottom perspective view of the cam journal cap 406.

FIG. 4 shows a first schematic 400 depicting the first isometric exploded view of the cylinder head 402, camshafts 404 and 405, and cam journal cap 406. The cylinder head 402 may be configured to receive and retain the camshafts 404 and 405 for actuation of one or more intake valves (e.g., intake valve 52*a* shown in FIG. 1) and exhaust valves (e.g., exhaust valve 54*a* shown in FIG. 1) of one or more engine cylinders (e.g., combustion chamber 30 shown in FIG. 1). Specifically, the cylinder head 402, may include one or more bearings 403 for receiving and retaining the camshafts 404 and 405. Thus, the camshafts 404 and 405, may rotate with respect to the bearings 403, but the bearings 403 may serve to restrict translational movement of the camshafts 404 and 405 with respect to the cylinder head 402. Semicircular recesses 418 may be included at an axial end the cylinder head 402. In the example shown in FIG. 4, the semicircular recesses 418 may be positioned at a first end 407 of the cylinder head 402. However, in alternate examples, the semicircular recesses 418 may be positioned at an opposite second end 409 of the cylinder head 402.

Additionally, the semicircular recesses 418 may include grooves for receiving oil from VCT oil control valves 410 and 411 VCT oil control valves 410 and 411 may be the same or similar to the VCT oil control valve 301 shown in FIGS. 3A-3C. As such, components of the VCT oil control valves 410 and 411 may be the same as VCT oil control valve 301. Further the VCT oil control valves 410 and 411 may function the same or similarly to oil control valve 301. Thus, the oil control valves 410 and 411 may be adjusted to an advanced position, such as the advanced second position shown in FIG. 3B, to flow oil to an advance chamber (e.g., advance chambers 134 and 144 shown in FIG. 1) to advance the timing of one or more of camshafts 404 and 405.

Thus, when the valves 410 and 411 are in an advanced position, oil from the valves 410 and 411 may flow into a first groove 421 of the semicircular recesses 418. From the first groove 421, oil may flow into one of the camshafts 404 or 405, via a first set of holes 422, which may direct the oil to the advance chamber of a camshaft phaser (not shown in FIG. 4). Similarly, when the valves 410 and 411 are in a retarded position, oil from the valves 410 and 411 may flow in a second groove 423 of the semicircular recesses 418. From the second groove 423, oil may flow into one of the camshafts 404 or 405, via a second set of holes 424, which may then direct the oil to a retard chamber of the camshaft phaser.

It is important to note that a dual independent camshaft timing system is shown in the example of FIG. 4. As such, two oil control valves 410 and 411 may be included. Oil control valves 410 and 411 may be identical in structure and function, and may only be different in that they regulate oil flow to different camshafts. Each oil control valve may be in fluidic communication with exactly one of the camshafts 404 and 405. First oil control valve 410 may regulate oil flow to camshaft 404, and the second oil control valve 411 may regulate oil flow to camshaft 405. The control valves 410 and 411 may be solenoid valves, where the position of each valve may be adjusted by a corresponding solenoid 412. In some examples, camshaft 404 may be an intake camshaft (e.g., intake camshaft 130 shown in FIG. 1), and may adjust the position of one or more intake valves, and camshaft 405 may be an exhaust camshaft (e.g., exhaust camshaft 140 shown in FIG. 1) and may adjust the position of one or more exhaust valves. As such, oil control valve 410 may regulate oil flow to advance and retard chambers of an intake camshaft (e.g., advance chamber 134 and retard chamber 132 shown in FIG. 1). Oil control valve 411 may therefore regulate oil flow to advance and retard chambers of an exhaust camshaft (e.g., advance chamber 144 and retard chamber 142 shown in FIG. 1). However, in alternate examples, camshaft 404 may be an exhaust camshaft, and camshaft 405 may be an intake camshaft. The camshafts 404 and 405 may include a plurality of cam lobes 428. The cam lobes 428 may be the same as cam lobes 131 and 141 shown above with reference to FIG. 1. Thus, as the camshafts 404 and 405 rotate, the position of the intake and exhaust valves may be adjusted based on the lift profile of the cam lobes 428.

The oil control valves 410 and 411 may each include a valve body 414, and a solenoid 412, where each solenoid 412 may be energized to adjust the position a spool (e.g., spool 304 shown in FIGS. 3A-3C) within the valve body 414. Specifically a controller (e.g., controller 12 shown in FIG. 1) may send electrical signals to the solenoids 412 to adjust the position of the valves 410 and 411. The valve body 414, may be similar in structure and function to the valve spool 304 shown above with reference to FIGS. 3A-3C. Similar to valve 301 shown in FIGS. 3A-3C, the valves 410 and 411 may each be housed in a vertical bore 413 or 415 of the cam journal cap 406. The vertical bores 413 and 415 may comprise a plurality of ports for directing oil into and out of the valves 410 and 411. Further, vertical bores 413 and 415 may be vertical bores in the cam journal cap 406. Thus, the housings for the valves 410 and 411 may be integrally formed as vertical bores within the cam journal cap 406. As such, first vertical bore 413 may be referred to as first valve housing 413, and second vertical bore 415 may be referred to as second valve housing 415. The vertical bores 413 and 415 may be included within a top face 417 of the cam journal cap 406. The top face 417 may be positioned vertically above a bottom face 419 of the cam journal cap 406 when included in an on-road vehicle. The vertical bores 413 and 415, may be hollow recesses in the top face 417 of the cam journal cap 406. Further the vertical bores 413 and 415 may be open at the top face 417 of the cam journal cap 406. In this way, the valve body 414 of each of the valves 410 and 411 may fit inside the bores 413 and 415, respectively.

It is important to note that although a dual independent cam timing system is shown in FIG. 4, other cam timing systems may be used. For example, only one camshaft may be included. In such examples where only one camshaft is included, only one VCT oil control valve, and one vertical bore may be included in the cam journal cap 406.

The cam journal cap 406 may therefore include vertical bores 413 and 415 which may form the housings of the VCT oil control valves 410 and 411, respectively. Additionally, the cam journal cap 406 may comprise complementary semicircular recesses 416 that may be shaped and sized similarly to semicircular recesses 418. The complementary semicircular recesses 416 may be included within the bottom face 419 of the cam journal cap 406. When assembled, semicircular recesses 418 and complementary semicircular recesses 416 may be in face sharing contact with camshafts 404 and 405. Further, the recesses 418 and 416 may fully encompass a circumference of the camshafts. Thus, oil from the oil control valves 410 and 411 may pass through the cam journal cap 406 en route to the grooves 421 and 423.

Camshafts 404 and 405 may each include a thrust ring 427, which may restrict relative translational movement between the camshafts 404 and 405, and the cylinder head 402. Specifically, each thrust ring 427 may restrict movement of the camshafts 404 and 405 perpendicular to the first and second ends 407 and 409, respectively. The thrust rings 427 may be lubricated with oil from the oil control valves 410 and 411 as introduced above in FIGS. 3A-3C. As such, the cam journal cap 406 may include one or more oil passages that fluidically couple the oil control valve 410 to thrust ring 427 of camshaft 404, and one or more oil passages that fluidically couple the oil control valve 411 to thrust ring 427 of camshaft 405.

In this way, the cam journal cap 406 may house the oil control valves 410 and 411. Further, the cam journal cap 406 may cover the camshafts 404 and 405, and may provide an oil flow path from the valves 410 and 411 to advance and retard chambers of a VCT timing system. Additionally, the cam journal cap 406, may provide an oil flow path from the valves 410 and 411 to a thrust ring 427 of each of the camshafts 404 and 405, for lubrication thereof. The structure of the cam journal cap 406 will be described in greater detail below with reference to FIGS. 6-8.

Turning now to FIG. 5, it shows a schematic 500 of a side perspective view of the cylinder head 402, cam journal cap 406, and camshafts 404 and 405 when assembled. Components already introduced in the description of FIG. 4, may not be reintroduced or described in the description of FIG. 5 herein. The camshafts 404 and 405 may sit in the semicircular recesses 418, and may be covered by the complementary semicircular recesses 416 of the cam journal cap 406. As shown in FIG. 5, the semicircular recesses 416 and 418 may extend around a circumference of the camshafts 404 and 405. Thus, the camshafts may be positioned vertically above the cylinder head 410, and the cam journal cap may be positioned vertically above the camshafts 404 and 405. More specifically, the semicircular recesses 416 of the cam journal cap 406 may be positioned vertically above the camshafts 404 and 405.

Complementary semicircular recesses 416 may be in sealing contact with the cylinder head 402. Specifically, the semicircular recesses 416 may be in sealing contact with the semicircular recesses 418 of the cylinder head 402 for retaining oil within grooves (e.g., grooves 421 and 423 shown in FIG. 4) in the recesses 416 and 418. In this way, the cam journal cap 406 may be physically coupled to the cylinder head 402. In some examples, as shown in FIG. 5, the cam journal cap 406 may be secured to the cylinder head 402 by bolts 502. However, in other examples, other means of fastening the cap 406 to the cylinder head 402 may be used such as screws, welding, ultrasonic welding, injection molding, etc. Thus, cam journal cap 406 may be in face sharing contact with the camshafts 404 and 405, and the cylinder head 402.

The thrust ring 427 of each of the camshafts 404 and 405 may be retained within a thrust bearing (e.g., thrust bearing 808 shown in FIG. 8) of the cam journal cap 406. In other examples, the semicircular recesses 418 of the cylinder head 402 may include bearings for receiving and retaining the thrust ring 427 of each of the cam shafts 404 and 405.

Moving on to FIG. 6, it shows a schematic 600 of a side perspective view of the cam journal cap 406. Components already introduced above with reference to FIGS. 4-5 may not be reintroduced or described again. Specifically, schematic 600 shows only one of the oil control valves 410 and 411. Although only oil control valve 411 of the cam journal cap 406 is shown in FIG. 6, it should be appreciated that the cam journal cap 406 may additionally include oil control valve 410. Since oil control valves 410 and 411 may be identical, it should be appreciated that the positioning, structure, and function of the valve 411 within the cam journal cap 406 provided in the description of FIG. 6 herein, may be the same as for valve 410. Similarly, although only vertical bore 415 is shown in FIG. 6, it should be appreciated that the cam journal cap 406 may additionally include vertical bore 413 shown above with reference to FIGS. 4-5 above. Since the vertical bores 413 and 415 may be identical in their positioning, structure, and function within the cam journal cap 406, it should be appreciated that the description of vertical bore 415 herein may also be applied to vertical bore 413.

Oil control valves 410 (not shown in FIG. 6) and 411 may each include a spool (e.g., spool 304 shown in FIGS. 3A-3C) housed in valve body 414, where the position of the spool relative to the body 414 may be actuable by the solenoid 412. Vertical bores 413 (not shown in FIG. 6) and 415, may therefore form the housings of the valves 410 and 411, respectively. Thus, the vertical bores 413 and 415 may be hollow recesses in the cam journal cap 406 that house the valve body 414 of each of the valves 410 and 411. The solenoid 412 may be positioned vertically above the cam journal cap 406 and the valve body 414. As such, the spool may fit inside and be fully enclosed by valve body 414 and the valve body 414 may be fully enclosed by the vertical bore 415. However, the valve body 414 may not extend to a bottom 614 of the vertical bore 415. As such, a hollow collection reservoir 606 (e.g., collection reservoir 336 shown in FIGS. 3A-3C) may be formed at the bottom 614 of the vertical bore 415, which does not include the body 414. A portion of the oil provided to the valve 411 may collect at the bottom 614 of the vertical bore 415 in the collection reservoir 606 as explained above with reference to FIGS. 3A-3C. Thus, the vertical bore 415 may be sealed at the bottom 614 so that oil may collect therein. In the example shown in FIG. 6, the vertical bore 415 is sealed at the bottom 614 with respect to the cam journal cap 406, so that no oil my flow out of the bottom 614 to other portions of the cam journal cap 406. In this way, any oil drained from the valve body 414 may collect at the bottom 614 of the vertical bore 415, in the collection reservoir 606. The vertical bore 415 may include a plurality of ports for flowing oil into and out of the valves 410 and 411.

Specifically, vertical bore 415 may include a first port 602, which may be the same as first port 326 shown above with reference to FIGS. 3A-3C. Thus, first port 602 may be configured to receive high pressure oil from an oil pump (not shown in FIG. 6). Specifically, oil may be supplied to the oil control valve via a supply channel 612, which may be the same or similar to supply channel 214*a* shown above with reference to FIG. 2. Thus, supply channel 612 may be physically coupled at one end to an oil pump (e.g., oil pump 208 shown in FIG. 2) and at an opposite end to the first port 602, for supplying oil from the pump to the oil control valve. Additionally, the vertical bore 415 may include second and third ports (shown below with reference to FIG. 7) for flowing oil to and from advance and retard chambers respectively, of a VCT system (e.g., VCT system 19 shown in FIG. 1). Thus, as described above with reference to FIG. 4, valves 410 and 411 may be purposed to regulate oil flow to cam phasers of a VCT system for adjusting the timing of one or more camshafts. Further, a portion of the oil provided to the valves 410 and 411 may also be used to lubricate a thrust bearing (e.g., thrust bearing 808 shown below with reference to FIG. 8) and/or thrust ring (e.g., thrust ring 427 shown in FIG. 4).

Further, the vertical bore 415 may include a fourth port 608, which may be the same as fourth port 332 shown above with reference to FIGS. 3A-3C. Thus, fourth port 608 may be positioned at or near the bottom 614 of the vertical bore 415 with respect to the ground when coupled in an on-road vehicle. The fourth port 608 may therefore be positioned in the collection reservoir 606 of the valve 411, where oil may collect. Collection reservoir 606 may be the same as collection reservoir 336 shown above with reference to FIGS. 3A-3C. As described above, the bottom 614 of the vertical bore 415 may be sealed, and as such a portion of oil entering the valve 411 may drain to the sealed bottom 614 of the vertical bore 415 and pool in the collection reservoir 606. Thus, the amount of oil collected at the bottom 614 of the vertical bore 415 in the collection reservoir 606 may increase as oil flow into or from the valve 411 increases. The collection reservoir 606, may comprise a portion of the vertical bore 415 that does not include the valve body 414. As described above with reference to FIGS. 3A-3C, the fourth port 608 may be submerged in oil. In some examples, the fourth port 608 may be positioned within the vertical bore 415 such that it is submerged in oil for a duration. In some examples, the duration may be number of engine cycles, amount of time, etc. In further examples, the duration may be a number of engine start and stops. Thus, in some examples, the fourth port 608 may be submerged in oil for substantially the entire duration of engine operation from when the engine is turned on to when the engine is turned off. The fourth port 608 may direct oil from the valve 411 to thrust ring 427 (shown in FIG. 4) and/or thrust bearing (shown in FIG. 8) for lubrication thereof. As such, fourth port 608, may also be referred to herein as thrust bearing port 608.

A drain port 610, which may be the same as drain port 334 shown above with reference to FIGS. 3A-3C, may be positioned vertically above the fourth port 608 as depicted in the example of FIG. 6. The drain port 610 may allow for oil to drain from the vertical bore 415 to an oil sump (not shown in FIG. 6), when oil levels in the collection reservoir 606 increase above a threshold as described above with reference to FIGS. 3A-3C. The fourth port 608 and the drain port 610 may be positioned vertically below a bottom 616 of the valve body 414. As such, the bottom 616 of the valve body 414 may not extend vertically below the fourth port 608 or the drain port 610. Thus, the entire valve body 414 may remain vertically above the fourth port 608 and drain port 610 during operation of the valve 411.

Thus, when oil levels in the collection reservoir 606 increase above the threshold, and the drain port 610 is submerged at least partially in oil, oil may exit the oil control valve 411 from both the fourth port 608 and the drain port 610. In this way, the drain port 610 and fourth port 608 may be said to be hydraulically in parallel when oil levels in the collection reservoir 606 increase above the threshold, because oil in the collection reservoir 606 may flow out of the valve 411 via either the drain port 610 or the fourth port 608. As such, oil flow through drain port 610 and fourth port 608 may be unidirectional in that oil may only flow out of the valve 411 via the drain port 610 and fourth port 608. However, in some examples, oil may flow from the thrust bearing back into the valve 411 via the fourth port 608.

As shown in FIG. 6, the drain port 610 and fourth port 608 may be diametrically opposed on opposite sides of the vertical bore 415. Thus, the drain port 610 and fourth port 608 may be offset from one another on the vertical bore 415 by a central angle of approximately 180 degrees. However, in other examples, the spacing of the drain port 610 and fourth port 608 may be greater or less than a central angle of 180 degrees.

The drain port 610 may be sized to be bigger than the fourth port 608. Thus, when submerged in oil, oil mass flow rates through the drain port 610 may be greater than through the fourth port 608. Specifically, the oil mass flow rates through the drain port 610 and fourth port 608 may be based both on the oil levels in the collection reservoir 606 and the size (e.g., diameter) of the ports 608 and 610. Thus, the hydraulic diameter, or cross sectional flow area, of the drain port 610 may be larger than the fourth port 608, so that when both are submerged in oil, the drain port 610 may allow for a greater oil mass flow rate there-through than the fourth port 608. The fourth port 608 may be sized sufficiently small so that it may provide a relatively constant mass flow rate of oil to the thrust bearing. In some examples, the fourth port 608 may be sized so that its diameter may be any diameter in a range of diameters between 3 and 5 mm. The drain port 610 may be sized so that its diameter may be any diameter in a range of diameters between 6 and 8 mm. In this way, fourth port 608, may act as a flow restriction, which may provide a substantially fixed flow rate of oil to the thrust bearing. By positioning the fourth port 608 below the drain port 610, oil flow to the thrust bearing may be regulated and metered at a steady flow rate. Further, by positioning the drain port 610 above the fourth port 608, oil levels in the collection reservoir 606 may be kept high enough to submerge the fourth port 608 during engine operation.

In this way, oil may collect at the bottom 614 of the vertical bore 415. A portion of the oil collected at the bottom of the vertical bore 415 may then flow out of the valve 411 to a thrust bearing for lubrication thereof via the fourth port 608. The fourth port 608 may be sized small enough so that while it enables oil to flow from the bottom of the vertical bore 415 to the thrust bearing, it also limits the amount of oil flowing to the thrust bearing to ensure that it is always submerged in oil. However, it should be appreciated that in other examples, the fourth port 608 may be sized sufficiently large such that it does not restrict oil flow, so long as there is some amount of collection volume below it in the reservoir 606.

If oil levels in the collection reservoir 606 exceed a threshold, oil may then flow out of the drain port 610. The drain port 610 may be sized to allow relatively unrestricted flow of oil out of the valve 411 when oil levels in the bottom of the vertical bore 415 exceed the threshold. By positioning the drain port 610 above the fourth port 608, excess oil may be drained from the valve 411 via the drain port 610, without causing oil levels to decrease below a level which would reduce oil flow through the fourth port 608. In this way, oil levels in the collection reservoir 606 may be kept to within a desired range, where the oil levels may kept high enough to keep the fourth port 608 submerged so that consistent oil flow to the thrust bearing may be maintained, but low enough so that the collected oil may not impede operation of the valve 411

It should also be appreciated that although the ports 608 and 610 are shown in the example of FIG. 6 as being circular, that in other examples, the ports 608 and 610 may be shaped differently. Similarly, port 602 may be rectangular as shown in the example of FIG. 6, however, it may be shaped differently in other examples. Thus, the ports 602, 608, and 610 may be square, rectangular, circular, triangular, etc. In some examples, the ports 602, 608, and 610 may be relatively hollow openings as shown in the example of FIG. 6. However, in other examples, the ports 602, 608 and 610 may not be hollow. Thus, in some examples, the ports 602, 608, and 610 may be perforated, or may include surface features such as grooves, ridges, etc.

Turning now to FIG. 7, it shows a schematic 700 exposing the interior of one of the vertical bores 413 and 415 of the cam journal cap 406. Specifically, FIG. 7 shows the positioning of second port 702 and third port 704 that may be in fluidic communication with advance and retard chambers, respectively, of a VCT system (e.g., VCT system 19 shown in FIG. 1). Components of the cam journal cap 406 already introduced above in FIGS. 4-6 may not be reintroduced or described again. Although only oil control valve 410 of cam journal cap 406 is shown in FIG. 7, it should be appreciated that the cam journal cap 406 may additionally include oil control valve 411. Since oil control valves 410 and 411 may be identical, it should be appreciated that the positioning, structure, and function of the valve 410 within the cam journal cap 406 provided in the description of FIG. 7 herein, may be the same as for valve 411. Similarly, although only vertical bore 413 is shown in FIG. 7, it should be appreciated that the cam journal cap 406 may additionally include vertical bore 415 shown above with reference to FIGS. 4-6 above. Since the vertical bores 413 and 415 may be identical in their positioning, structure, and function within the cam journal cap 406, it should be appreciated that the description of vertical bore 413 herein may also be applied to vertical bore 415.

As shown in the example of FIG. 7, second port 702 may be positioned vertically above the first port 602 in the vertical bore 413. The second port 702 may provide fluidic communication between the valve 410 and first groove 721, which may direct oil to an advance chamber (e.g., advance chamber 134 shown in FIG. 1) of a VCT system (e.g., VCT system 19 shown in FIG. 1). Specifically, first groove 721 of the cam journal cap 406, and first groove 421 of the cylinder head 402 (shown above with reference to FIG. 4), may be in sealing contact with one another, and may fully encompass the camshaft 404. When assembled therefore, the first grooves 421 and 721 may form a sealed hollow annulus around the camshaft 404. Thus, oil may flow from second port 702 into the sealed annulus formed by the first grooves 421 and 721, so that the oil flows around a circumference of the camshaft. Thus, the position of a spool (e.g., spool 304 shown in FIGS. 3A-3C) may be adjusted to allow oil to flow from the valve 410 to the second port 702. From the second port 702, oil may flow through the cam journal cap 406 to the first groove 421, en route to the advance chamber of the VCT system. Additionally or alternatively, oil may flow the opposite direction, from the first groove 421 to the second port 702 and into the valve 410. The direction of oil flow through the second port 702 may depend on the position of the spool within the valve body 414.

Third port 704 may be positioned vertically below the first port 602 and second port 702. However, the third port 704 may be positioned vertically above the drain port 610. The third port 704 may provide fluidic communication between the valve 410 and second groove 723. Second groove 723 may direct oil to a retard chamber (e.g., retard chamber 132 shown in FIG. 1) of the VCT system. Specifically, second groove 723 of the cam journal cap 406, and second groove 423 of the cylinder head 402 (shown above with reference to FIG. 4), may be in sealing contact with one another, and may fully encompass the camshaft 404. When assembled therefore, the second grooves 423 and 723 may from a sealed hollow annulus around the camshaft 404. Thus, oil may flow from third port 704 into the sealed annulus formed by the second grooves 423 and 723, so that the oil flows around a circumference of the camshaft. Thus, the position of the spool may be adjusted to allow oil to flow from the valve 410 to the third port 704. From the third port 704, oil may flow through the cam journal cap 406 to the second groove 423, en route to the retard chamber of the VCT system. Additionally or alternatively, oil may flow the opposite direction, from the first groove 421 to the third port 704 and into the valve 410. The direction of oil flow through the third port 704 may depend on the position of the spool within the valve body 414.

Thus, the timing of a camshaft (e.g., camshaft 404 shown in FIG. 4) relative to a crankshaft (e.g., crankshaft 40 shown in FIG. 1), may be adjusted by regulating the flow of oil out of the valve 410 via the second port 702 and third port 704. By adjusting the position of the spool to allow oil to flow out of the second port 702 to the advance chamber, the timing of the camshaft may be advanced. Conversely, the timing of the camshaft may be retarded by adjusting the position of the spool to allow oil to flow out of the third port 704 to the retard chamber.

A portion of oil flowing into the valve 410 from any one of the first port 602, second port 702, and third port 704 may drain to the collection reservoir 606 at the bottom 614 of the vertical bore 413. The valve body 414 may further include a drainage hole 706 for draining oil in the valve body 414 to the collection reservoir 606. Thus, a portion of the oil entering into the valve 410 may flow into the valve body 414, exit the valve body 414 through the drainage hole 706, and collect at the bottom 614 of the vertical bore 413 in the collection reservoir 606. In some examples, oil may also flow between the vertical bore 413 and the valve body 414, and collect in the collection reservoir 606 as described above in FIGS. 3A-3C.

In this way, high pressure oil may be supplied to the oil control valve 410 via the first port 602. The position of the valve 410, specifically the valve body 414, may be adjusted to regulate oil flow to the advance and retard chambers of the VCT system. In this way, the valve 410 may adjust the timing of a camshaft. Further, the oil supplied to the valve 410 may be used to lubricate a thrust bearing and/or thrust ring. Specifically, oil supplied to the valve 410 may drain to the bottom of the vertical bore 413. Collected oil, may then be directed to the thrust bearing and/or thrust ring for lubrication thereof via the fourth port 608. If oil level in the collection reservoir 606 exceed a threshold, excess oil may be drained from the valve 410 to an oil sump via the drain port 610. In this way, the cam journal cap 406 and valves 410 and 411 (not shown in FIG. 7) may serve a dual function. Together the cam journal cap 406 and valves 410 and 411 may not only be used to adjust the timing of a camshaft, but they may also serve to lubricate a thrust bearing and/or thrust ring.

Turning now to FIG. 8, it shows a schematic 800 of a bottom perspective view of the cam journal cap 406. Components of the cam journal cap 406 and camshaft 405 already introduced above in FIGS. 4-7 may not be reintroduced or described again. As described above with reference to FIG. 7, oil from an oil control valve such as oil control valve 411 shown in FIG. 8, may be directed to one or more of a first groove 721 and/or a second groove 723 of the cam journal cap. Oil directed to the first groove 721 may flow into the camshaft 405 via the first set of holes 422 en route to a cam phaser (not shown in FIG. 8) for adjusting the timing of the camshaft 405. Specifically, oil directed to the first groove 721 and first set of holes 422, may flow through the camshaft 405 to an advance chamber (e.g., advance chamber 144 shown in FIG. 1) of a VCT system (e.g., VCT system 19 shown in FIG. 1). Similarly, oil directed to the second groove 723 may flow into the camshaft 405 via the second set of holes 424 en route to the cam phaser for adjusting the timing of the camshaft 405. Specifically, oil directed to the second groove 723 and second set of holes 424 may flow through the camshaft 405 to a retard chamber (e.g., retard chamber 142 shown in FIG. 1) of the VCT system.

Further, FIG. 8 shows the thrust ring 427 retained within a thrust bearing 808 of the cam journal cap 406. Thus, the thrust bearing 808 may be a groove in the cam journal cap 406 for receiving and retaining the thrust ring 427. The thrust ring 427 and thrust bearing 808 may therefore be in face sharing contact with one another. Further, the thrust ring 427 may rotate with respect to the thrust bearing 808 as the camshaft 405 rotates. Together, the thrust bearing 808 and thrust ring 427 may serve to restrict movement of the camshaft 405 along axis Y-Y.'

However, due to the rotation of the thrust ring 427 relative to the thrust bearing 808, the thrust ring 427 and thrust bearing 808 may require lubrication. As described above with reference to FIGS. 5-7, oil from the oil control valve 411 may be routed to the thrust bearing 808 and/or thrust ring 427 for lubrication thereof. As shown in FIG. 8, the fourth port 608, may be in fluidic communication with the valve 411 and the thrust bearing 808 for providing a path for oil to flow between the valve 411 and the thrust bearing 808. Thus, oil may flow from the valve 411, to the thrust bearing 808 via the fourth port 608. In this way, the cam journal cap 406 may direct oil to an advance and/or retard chamber of a VCT system for adjusting the timing of a camshaft. Additionally, the cam journal cap may include a port for directing oil to a thrust bearing and/or thrust ring for lubrication thereof. An example method for regulating oil flow within the cam journal cap and oil control valve are shown below with reference to FIG. 9.

Turning now to FIG. 9, it shows a flow chart of an example method 900 for adjusting oil flow through a control valve (e.g., oil control valves 410 and 411 shown in FIG. 4) of a variable cam timing system (e.g., VCT system 19 shown in FIG. 1). During engine operation the position of a camshaft (e.g., camshaft 404 shown in FIG. 4) may be adjusted depending on engine operating conditions to increase fuel efficiency. In some examples, the position of the camshaft may be advanced by flowing oil to an advance chamber (e.g., advance chamber 134 shown in FIG. 1) of a cam phaser of the VCT system. However, in other examples, the position of the camshaft may be retarded by flowing oil to a retard chamber (e.g., retard chamber 132 shown in FIG. 1) of the cam phaser. A cam journal cap (e.g., cam journal cap 406 shown in FIGS. 4-8) may cover the camshaft, and may house the control valve, which regulates oil flow to the advance and retard chambers of the VCT system. Further, the cam journal cap may include a thrust bearing (e.g., thrust bearing 808 shown in FIG. 8) which may retain a thrust ring (e.g., thrust ring 427 shown in FIG. 4). The thrust ring may rotate relative to the thrust bearing as the camshaft rotates during engine operation, but together, the thrust bearing and the thrust bearing may interact to restrict translational movement of the camshaft. The cam journal cap may provide lubrication for the thrust bearing and thrust ring via oil provided to the oil control valve.

Instructions for executing method 900 may be stored in the memory of a controller (e.g., controller 12 shown in FIG. 1). Therefore method 900 may be executed by the controller based on the instructions stored in the memory of the controller and in conjunction with signals received from sensors of the engine system, such as the sensors described above with reference to FIG. 1. The controller may employ engine actuators of the engine system to adjust engine operation according to the method 900 described below. In particular, the controller may adjust oil flow to one or more of the advance chamber, retard chamber, thrust bearing, and oil sump (e.g., oil sump 202 shown in FIG. 2) based on a desired camshaft position and an oil flow rate into the control valve.

Method 900 begins at 902 which comprises estimating and/or measuring engine operating conditions. Engine operating conditions may include an engine speed, a throttle position, an engine load, an operator commanded torque, an intake mass airflow, a fuel injection amount, etc.

After estimating and/or measuring engine operating conditions at 902, method 900 may continue to 904 which comprises flowing oil into a vertical bore (e.g., vertical bore 413 shown in FIG. 4) of the cam journal cap via an inlet first port (e.g., first port 602 shown in FIGS. 6-8). Pressurized oil may be provided to the vertical bore from an oil pump (e.g., oil pump 208 shown in FIG. 2). Thus, the method 900 at 904 may comprise flowing oil from the oil pump to the cam journal cap, and into the vertical bore of the cam journal cap which houses the control valve via the first port.

Method 900 may then proceed to 906 which comprises determining a desired camshaft timing. The desired camshaft timing may be determined based on the operator commanded torque which may be estimated based on a position of an input device (e.g., input device 192 shown in FIG. 1) as estimated based on outputs from a position sensor (e.g., pedal position sensor 194 shown in FIG. 1). Additionally or alternatively, the desired camshaft timing may be determined based on an intake mass airflow, throttle position, fuel injection amount, etc.

After determining the desired camshaft timing at 906, method 900 may then proceed to 908 which comprises adjusting the position of the control valve to regulate oil flow within the cam journal cap to achieve the desired camshaft timing. More specifically, the method 900 and at 908 may comprise adjusting the position of a spool (e.g., spool 304 shown in FIGS. 3A-3C) of the valve within a valve body (e.g., valve body 302 shown in FIGS. 3A-3C) of the valve to regulate oil flow to the advance chamber and/or retard chamber of the VCT system. In one example, as shown above in FIG. 3A, if the desired camshaft timing is substantially the same as the current camshaft timing, the valve may be adjusted to a neutral first position so that the camshaft timing is relatively maintained. However, in another example, as shown above in FIG. 3B, if the desired camshaft timing is more advanced than the current camshaft timing, the valve may be adjusted to a more advanced position, so that oil flow through a second port (e.g., second port 702 shown in FIG. 7) of the vertical bore to the advance chamber may be increased, and therefore the camshaft timing may be advanced. In yet another example, as shown above in FIG. 3C, if the desired camshaft timing is more retarded than the current camshaft timing, the valve may be adjusted to a more retarded position so that the oil flow through a third port (e.g., third port 704 shown in FIG. 7) of the vertical bore to the retard chamber may be increased, and therefore the camshaft timing may be retarded.

Method 900 may then continue from 908 to 910 which comprises flowing a portion of oil into a collection chamber (e.g., collection reservoir 606 shown in FIGS. 6-7) of the vertical bore of the cam journal cap. As shown above with reference to FIGS. 3A-3C and FIG. 8, oil may drain from the valve to the bottom of the collection chamber. Thus, the method at 900 may comprise flowing oil into a hollow passage (e.g., hollow passage 328 shown in FIGS. 3A-3C) of the valve body and out through an opening (e.g., drainage hole 706 shown in FIG. 7) of the valve body to the collection chamber. In other examples, the method 900 at 910 may additionally or alternatively comprise flowing (leakage) a portion of the oil in the valve, around edges of the spool, between the spool and the valve body, to the bottom of the valve body, and then to the collection chamber via the opening. In still further examples, the method 900 at 910 may include flowing a portion of oil through a gap (e.g., gap 325 shown in FIGS. 3A-3C) formed between the valve body and the vertical bore to the collection reservoir. Thus, a portion of oil flowing into and/or out of the vertical bore via one or more of the first, second, and third ports, may be drained to the collection reservoir.

After flowing oil to the collection chamber at 910, method 900 may then continue to 912 which comprises routing a portion of oil in the collection chamber to the thrust bearing via a thrust bearing port (e.g., fourth port 608 shown in FIGS. 6-8) in the vertical bore. Thus, the method at 912 may comprise flowing a portion of oil in the collection chamber through the thrust bearing port, to the thrust bearing for lubrication thereof. More specifically, in one example, the method at 912 may comprise flowing a metered amount of oil to the thrust bearing, where the metered amount of oil may be based on the size of the thrust bearing port.

After lubricating the thrust bearing and/or thrust ring at 912, method 900 may then continue to 914 which comprises determining if the oil level in the collection chamber is greater than a threshold. The threshold at 914 may represent an oil level in the collection chamber above which may restrict movement of the spool within the valve body. Thus, the threshold at 914 may represent an oil level in the collection chamber, which if exceeded would result in reduced performance of the VCT system or VCT unit. However, in other examples, the threshold at 914 may alternatively or additionally represent an oil level in the collection chamber which if exceeded would result in a drain port (e.g., drain port 610 shown in FIGS. 6-8) to become submerged in oil. In such examples, where the threshold is exceeded therefore, oil would flow out of the drain port, and out of the valve to the oil sump. Since the drain port may be positioned vertically above the thrust bearing port, the threshold oil level at 914 may represent a high oil level than what would cause the thrust bearing port to be submerged. In this way, the method 900 may comprise continually flowing oil to the thrust bearing via the thrust bearing port, even when oil levels in the collection chamber are below the threshold.

If it is determined at 914 that the oil levels in the collection chamber are not greater than the threshold at 914, then method 900 may continue to 916 which comprises flowing oil to the thrust bearing only from the collection chamber. Thus, the method 900 may comprise flowing oil to the thrust bearing via the thrust bearing port and not to the oil sump via the drain port if the oil levels in the collection chamber are not greater than the threshold. Method 900 then returns.

However, if it is determined at 914 that the oil levels in the collection chamber are greater than the threshold at 914, then method 900 may continue to 918 which comprises draining oil to the oil sump from the collection chamber via the drain port in the vertical bore. Additionally, the method at 918 may comprise continuing to flow oil to the thrust bearing via the thrust bearing port. Thus, the method 900 at 918 may comprise flowing oil out of the valve via the drain port and the thrust bearing port to the oil sump and thrust bearing, respectively. Method 900 then returns.

In this way, a cam journal cap may include a semicircular recess with a grove forming a thrust bearing for receiving and retaining a thrust ring of a camshaft. Together, the thrust ring and thrust bearing may reduce translational movement of the camshaft relative to a cylinder head and the cam journal cap. Further, the cam journal cap may comprise a vertical bore, open at a top surface for receiving and housing an oil control valve of a variable valve timing system. The vertical bore may be sealed at the bottom, so that oil drained from the control valve may collect at the bottom of the vertical bore. In addition to including ports for directing oil to an advance and retard chambers of the variable valve timing system, the vertical bore may also include a drain port and a thrust bearing port positioned vertically below the control valve. The thrust bearing port may be fluidically coupled to the thrust bearing, for providing oil from the bottom of the control valve to the thrust bearing. In this way, the consistency of oil flow provided to the thrust bearing may be increased. Further, the drain port, may be sized and positioned vertically above the thrust bearing port for draining excess oil in the bottom of the control valve to an oil sump.

In this way, a technical effect of increasing lubrication efficiency of a thrust bearing may be increased by providing a vertical bore with a sealed bottom in a cam journal cap for collecting oil from an oil control valve of a variable valve timing system. By collecting oil in the bottom of the vertical bore from the oil control valve, and routing a portion of the collected oil to the thrust bearing via a thrust bearing port in the vertical bore, consistent oil flow may be provided to the bearing. A second technical effect of reducing the size and cost of an engine oil system may be achieved, by providing oil to the thrust bearing from a control valve configured to regulate oil flow to advance and retard chambers of a variable valve timing system. By directing oil from the control valve, through the camp journal cap which houses the control valve, to the thrust bearing, the amount of oil in the engine oil system may be reduced, and further, the pressure required to pump oil through the oil system may be reduced. In this way, the size, and power of the pump may be reduced.

In one representation, a cam journal cap may comprise a thrust bearing coupled to a camshaft, a vertical bore housing a control valve, the control valve regulating oil received from an oil pump to control a position of the camshaft, a port positioned in the vertical bore and coupled to the thrust bearing to supply oil thereto, and a drain port positioned in the vertical bore above the port and coupled to an oil sump. In a first example, the cam journal cap may further comprise a semicircular recess within a bottom face of the journal cap for covering the camshaft, where the thrust bearing may comprise a groove within said semicircular recess. In a second example off the cam journal cap, the vertical bore may form a housing of the control valve, where the control valve may include a spool, movable within valve body for adjusting oil flow through the valve. In a third example of the cam journal cap, each of the port and the drain port may be vertically below a bottom end of the control valve. In a fourth example of the cam journal cap, the port and the drain port may be disposed at diametrically opposed angular positions. In a fifth example of the cam journal cap, the port and drain port may be hydraulically in parallel. In a sixth example of the cam journal cap, a cross sectional flow area of the port may be less than a cross sectional flow area of the drain port. In a seventh example of the cam journal cap, oil may flow through the drain port only during conditions in which oil levels the vertical bore are above a threshold.

In another representation, a cam journal cap coupled to a cylinder head of an engine system, may comprise: a semicircular recess within a bottom face of the journal cap for covering a camshaft, said semicircular recess including a thrust bearing for accepting a thrust ring of the camshaft, and a vertical bore within a top face of the journal cap configured to house a control valve for a variable camshaft timing mechanism. The vertical bore may include: a first port to receive oil from an oil pump, a second port, positioned vertically above the first port, coupled to an advance chamber of the variable timing mechanism, a third port, positioned vertically below the first port, coupled to a retard chamber of the variable timing mechanism, a fourth port, positioned vertically below the third port, coupled to the thrust bearing, and a drain port, positioned vertically between the third port and the fourth port, coupling the vertical bore to an oil sump. In a first example of the cam journal cap, a bottom of the vertical bore may be configured to collect at least a portion of oil delivered to the vertical bore from the oil pump. In a second example of the cam journal cap, an amount of oil collected in the bottom of the vertical bore may be sufficient to submerge the fourth port in oil during engine operation. In a third example of the cam journal cap, the fourth port and drain port may be hydraulically in parallel, so that oil may flow out of both the fourth port and drain port when oil levels in the vertical bore exceed a threshold. In as fourth example of the cam journal cap, oil may flow out of the vertical bore through the fourth port and not the drain port when oil levels decrease below the threshold. In a fifth example of the cam journal cap, the semicircular recess may further include a first groove in fluidic communication with the second port and the advance chamber, for directing oil from the second port to the advance chamber. In a sixth example of the cam journal cap, the semicircular recess may further include a second groove in fluidic communication with the third port and the retard chamber, for directing oil from the third port to the retard chamber. In a seventh example of the cam journal cap, the control valve may further comprise one or more drainage apertures positioned at a bottom of the valve for draining oil to a bottom of the vertical bore. In an eighth example of the cam journal cap, oil flow through the second and third ports may be bidirectional. In a ninth example of the cam journal cap, oil flow through the fourth port and drain port may be unidirectional, out of the valve.

In another representation, a method may comprise delivering oil to an oil control valve housed in a vertical bore in a cam journal cap of a variable camshaft timing system, collecting a portion of the oil in a bottom portion of the vertical bore, directing a portion of the oil from the bottom portion of the bore to a camshaft thrust bearing of the variable camshaft timing system, and maintaining oil levels in the bottom portion of the bore to below a threshold. In some examples, the method may further comprise one or more of adjusting a position of the valve towards a more advanced position and increasing an amount of oil flowing to an advance chamber of a variable cam timing system in response to an advancing of a desired camshaft timing, and adjusting the position of the valve towards a more retarded position and increasing an amount of oil flowing to a retard chamber of the variable cam timing system in response to the a retardation of the desired camshaft timing.

In a further representation a cam journal cap may comprise a thrust bearing for receiving a thrust ring of a camshaft, and a vertical bore configured to house a control valve for a variable camshaft timing (VCT) system, where the vertical bore may include: a first port for receiving oil from an oil pump, a second port for flowing oil to an advance chamber of the VCT system, a third port for flowing oil to a retard chamber of the VCT system, a fourth port, coupled to the bearing for flowing oil thereto, and a drain port for flowing oil to an oil sump. In a first example, the cam journal cap may further comprise a semicircular recess within a bottom face of the journal cap for covering the camshaft, where the thrust bearing may comprise a groove within said semicircular recess. In a second example off the cam journal cap, the vertical bore may form a housing of the control valve, where the control valve may include a spool, movable within a valve body of the valve for adjusting oil flow through the valve. In a third example of the cam journal cap, each of the fourth port and the drain port may be vertically below a bottom end of the spool and valve body of the control valve. In a fourth example of the cam journal cap, the fourth port and the drain port may be disposed at diametrically opposed angular positions. In a fifth example of the cam journal cap, the fourth port and drain port may be hydraulically in parallel. In a sixth example of the cam journal cap, a cross sectional flow area of the fourth port may be less than a cross sectional flow area of the drain port. In a seventh example of the cam journal cap, oil may flow through the drain port only during conditions in which oil levels in the control valve are above a threshold.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A cam journal cap comprising:

a thrust bearing housed by the cam journal cap and coupled to a camshaft;

a vertical bore housing a control valve, the control valve regulating oil received from an oil pump to control a position of the camshaft, wherein the vertical bore is at a right angle with respect to ground when included in an on-road vehicle;

a port positioned in the vertical bore and coupled to the thrust bearing to supply oil thereto;

a drain port positioned in the vertical bore above the port and coupled to an oil sump; and an inlet port for receiving oil from the oil pump, wherein the inlet port is positioned vertically above the port and drain port.

2. The cam journal cap of claim 1, further comprising a semicircular recess within a bottom face of the journal cap for covering the camshaft, where the thrust bearing comprises a groove within said semicircular recess.

3. The cam journal cap of claim 1, wherein the vertical bore forms a housing of the control valve, and where the control valve includes a spool, movable within a body of the control valve for adjusting oil flow through the valve.

4. The cam journal cap of claim 3, wherein each of the port and the drain port are vertically below a bottom end of the spool and the body of the control valve.

5. The cam journal cap of claim 3, wherein the control valve includes an opening at a bottom of the valve that drains oil to a bottom of the vertical bore.

6. The cam journal cap of claim 1, wherein the port and the drain port are disposed at diametrically opposed angular positions.

7. The cam journal cap of claim 1, wherein the port and the drain port are hydraulically in parallel when oil levels in the vertical bore are greater than a threshold.

8. The cam journal cap of claim 1, wherein a cross sectional flow area of the port is less than a cross sectional flow area of the drain port.

9. The cam journal cap of claim 1, wherein oil flows through the drain port only during conditions in which oil levels in the vertical bore are above a threshold.

10. A cam journal cap coupled to a cylinder head of an engine system, the journal cap comprising:

a semicircular recess within a bottom face of the journal cap for covering a camshaft, said semicircular recess including a thrust bearing for accepting a thrust ring of the camshaft; and a vertical bore within a top face of the journal cap configured to house a control valve for a variable camshaft timing mechanism, wherein the vertical bore is at a right angle with respect to ground when included in an on-road vehicle, said vertical bore including:

a first port to receive oil from an oil pump;

a second port, positioned vertically above the first port, coupled to an advance chamber of the variable timing mechanism;

a third port, positioned vertically below the first port, coupled to a retard chamber of the variable timing mechanism;

a fourth port, positioned vertically below the third port, coupled to the thrust bearing; and a drain port, positioned vertically between the third port and the fourth port, coupling the vertical bore to an oil sump.

11. The cam journal cap of claim 10, wherein a bottom of the vertical bore is sealed to collect at least a portion of oil received from the oil pump.

12. The cam journal cap of claim 11, where an amount of oil collected in the bottom of the vertical bore is always sufficient to submerge the fourth port in oil during engine operation.

13. The cam journal cap of claim 10, wherein the fourth port and the drain port are hydraulically in parallel when oil levels in the vertical bore exceed a threshold, so that oil flows out of both the fourth port and the drain port when oil levels in the vertical bore exceed the threshold.

14. The cam journal cap of claim 13, wherein the fourth port and the drain port are positioned in the vertical bore so that oil flows out of the valve through the fourth port and not the drain port when oil levels decrease below the threshold.

15. The cam journal cap of claim 10, wherein the semi-circular recess further includes a groove in fluidic communication with the second port and the advance chamber, for directing oil from the second port to the advance chamber.

16. The cam journal cap of claim 10, wherein the semi-circular recess further includes a groove in fluidic communication with the third port and the retard chamber, for directing oil from the third port to the retard chamber.

17. The cam journal cap of claim 10, wherein the control valve further comprises a hollow passage for draining oil to a bottom of the vertical bore.

18. The cam journal cap of claim 10, wherein oil flow through the second and third ports is bidirectional.

19. The cam journal cap of claim 10, wherein oil flow through the fourth port and the drain port is unidirectional, out of the valve.

20. The cam journal cap of claim 10, wherein the first port and the fourth port are positioned at a diametrically opposed angular position in the vertical bore relative to the second, third, and drain ports.

21. A method, comprising:

delivering oil to an oil control valve housed in a vertical bore in a cam journal cap of a variable camshaft timing system through an intake port in the vertical bore, wherein the vertical bore is at a right angle with respect to ground when included in an on-road vehicle;

housing a camshaft thrust bearing of the variable camshaft timing system in the cam journal cap;

collecting a portion of the oil in a bottom portion of the vertical bore;

directing a portion of the oil in the bottom portion of the vertical bore through a thrust bearing port in the vertical bore to the camshaft thrust bearing of the variable camshaft timing system; and flowing a portion of the oil in the bottom portion of the vertical bore through a drain port in the vertical bore to an oil sump when oil levels in the bottom portion of the vertical bore increase above a threshold, wherein the thrust bearing port and the drain port are positioned below the intake port.

22. The method of claim 21, further comprising adjusting a position of the valve towards a more advanced position and increasing an amount of oil flowing to an advance chamber of the variable cam timing system in response to an advancing of a desired camshaft timing, and adjusting the position of the valve towards a more retarded position and increasing an amount of oil flowing to a retard chamber of the variable cam timing system in response to a retardation of the desired camshaft timing.

* * * * *